US007249022B2

(12) United States Patent
Kayama et al.

(10) Patent No.: US 7,249,022 B2
(45) Date of Patent: Jul. 24, 2007

(54) SINGING VOICE-SYNTHESIZING METHOD AND APPARATUS AND STORAGE MEDIUM

(75) Inventors: Hiraku Kayama, Hamamatsu (JP); Oscar Celma, Barcelona (ES); Jaume Ortola, Benissa (ES)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/292,035

(22) Filed: Dec. 1, 2005

(65) Prior Publication Data

US 2006/0085196 A1 Apr. 20, 2006

Related U.S. Application Data

(62) Division of application No. 10/034,352, filed on Dec. 27, 2001, now Pat. No. 7,125,084.

(30) Foreign Application Priority Data

Dec. 28, 2000 (JP) ..... 2000-402880

(51) Int. Cl.
*G10L 13/04* (2006.01)
*G10L 13/08* (2006.01)
*G10H 1/02* (2006.01)

(52) U.S. Cl. ..... 704/267; 704/268; 84/622; 84/668

(58) Field of Classification Search ..... 704/258, 704/260, 267, 268, 269, 270; 84/622, 628, 84/659, 665, 668
See application file for complete search history.

(56) References Cited

U.S. PATENT DOCUMENTS 4,771,671 A * 9/1988 Hoff, Jr. ..... 84/645
5,536,902 A * 7/1996 Serra et al. ..... 84/623
5,642,470 A * 6/1997 Yamamoto et al. ..... 704/270
5,703,308 A * 12/1997 Tashiro et al. ..... 84/609
5,703,311 A * 12/1997 Ohta ..... 84/622
5,857,171 A * 1/1999 Kageyama et al. ..... 704/268

(Continued)

FOREIGN PATENT DOCUMENTS

JP 10-49169 2/1998

OTHER PUBLICATIONS

Merriam-Webster Online Dictionary, Definition of "Portamento", 1 Page.*

*Primary Examiner*—Martin Lerner
(74) *Attorney, Agent, or Firm*—Pillsbury Winthrop Shaw Pittman LLP

(57) ABSTRACT

There are provided a singing voice-synthesizing method and apparatus capable of performing synthesis of natural singing voices close to human singing voices based on performance data being input in real time. Performance data is inputted for each phonetic unit constituting a lyric, to supply phonetic unit information, singing-starting time point information, singing length information, etc. Each performance data is inputted in timing earlier than the actual singing-starting time point, and a phonetic unit transition time length is generated. By using the phonetic unit transition time, the singing-starting time point information, and the singing length information, the singing-starting time points and singing duration times of the first and second phonemes are determined. In the singing voice synthesis, for each phoneme, a singing voice is generated at the determined singing-starting time point and continues to be generated for the determined singing duration time.

4 Claims, 38 Drawing Sheets

U.S. PATENT DOCUMENTS 5,876,213 A 3/1999 Matsumoto
5,878,213 A * 3/1999 Matsumoto ..... 434/307 A
5,895,449 A 4/1999 Nakajima et al.
5,998,725 A 12/1999 Ohta
6,036,498 A * 3/2000 Kondo ..... 434/307 A
6,304,846 B1 * 10/2001 George et al. ..... 704/270
6,462,264 B1 * 10/2002 Elam ..... 84/645
6,836,761 B1 * 12/2004 Kawashima et al. ..... 704/258
7,117,154 B2 * 10/2006 Yoshioka et al. ..... 704/258
7,124,084 B2 * 10/2006 Kayama et al. ..... 704/267
2002/0105359 A1 8/2002 Shimizu et al.
2002/0123990 A1 9/2002 Abe et al.
2002/0184032 A1 12/2002 Hisaminato et al.
2003/0009344 A1 1/2003 Kayama et al.
2003/0221542 A1 12/2003 Kenmochi et al.
2004/0027369 A1 2/2004 Kellock et al.
2004/0133425 A1 7/2004 Kawashima

* cited by examiner

*FIG. 4*

| PERFORMANCE INFORMATION | INFORMATION | EXPLANATION |
|---|---|---|
| NOTE INFORMATION | Note On | ACTUAL SINGING-STARTING TIME |
| | Duration | ACTUAL SINGING LENGTH |
| | Pitch | SINGING VOICE PITCH |
| PHONETIC UNIT TRACK INFORMATION | PhU | SINGING PHONETIC UNIT |
| | Consonant Modification | SINGING CONSONANT EXPANSION/COMPRESSION RATIO |
| TRANSITION TRACK INFORMATION | Attack Type | SINGING ATTACK TYPE |
| | Attack Rate | SINGING ATTACK EXPANSION/COMPRESSION RATIO |
| | Release Type | SINGING RELEASE TYPE |
| | Release Rate | SINGING RELEASE EXPANSION/COMPRESSION RATIO |
| | Note Transition Type | SINGING NOTE TRANSITION TYPE |
| | Note Transition Rate | SINGING NOTE TRANSITION EXPANSION/COMPRESSION RATIO |
| VIBRATO TRACK INFORMATION | Vibrato Number | NUMBER OF VIBRATO EVENTS IN PERFORMANCE DATA |
| | Vibrato Delay 1 | FIRST VIBRATO DELAY TIME |
| | Vibrato Duration 1 | FIRST VIBRATO DURATION TIME |
| | Vibrato Type 1 | FIRST VIBRATO TYPE |
| | ⋮ | ⋮ |
| | Vibrato Delay K | K-TH VIBRATO DELAY TIME |
| | Vibrato Duration K | K-TH VIBRATO DURATION TIME |
| | Vibrato Type K | K-TH VIBRATO TYPE |

FIG. 5

| PHONETIC UNIT | PITCH | |
|---|---|---|
| a | P1 | TONE GENERATOR CONTROL INFORMATION |
| | P2 | TONE GENERATOR CONTROL INFORMATION |
| | ⋮ | ⋮ |
| i | P1 | |
| | ⋮ | |
| M | ⋮ | |
| ⋮ | ⋮ | |
| Sil | ⋮ | |

FIG. 6A

| PHONETIC UNIT TRANSITION TIME LENGTH |
| --- |
| (a) V_Sil TRANSITION TIME LENGTH |
| (b) Sil_C TRANSITION TIME LENGTH |
| (c) C_V TRANSITION TIME LENGTH |
| (d) Sil_V TRANSITION TIME LENGTH |
| (e) pV_C TRANSITION TIME LENGTH |
| (f) pV_V TRANSITION TIME LENGTH |

FIG. 6B

| PRECEDING PHONETIC UNIT | FOLLOWING PHONETIC UNIT | PITCH | | |
|---|---|---|---|---|
| a | i | P1 | PHONETIC UNIT TRANSITION TIME LENGTH | TONE GENERATOR CONTROL INFORMATION |
| | | P2 | PHONETIC UNIT TRANSITION TIME LENGTH | TONE GENERATOR CONTROL INFORMATION |
| | | ⋮ | ⋮ | ⋮ |
| | M | P1 | | |
| | | ⋮ | | |
| | ⋮ | ⋮ | | |
| | Aspiration | ⋮ | | |
| | Sil | ⋮ | | |
| i | a | ⋮ | | |
| | M | ⋮ | | |
| | ⋮ | ⋮ | | |
| | Aspiration | ⋮ | | |
| | Sil | ⋮ | | |
| M | a | ⋮ | | |
| | i | ⋮ | | |
| | ⋮ | ⋮ | | |
| | Aspiration | ⋮ | | |
| | Sil | ⋮ | | |
| ⋮ | ⋮ | ⋮ | | |
| Sil | a | ⋮ | | |
| | i | ⋮ | | |
| | M | ⋮ | | |
| | ⋮ | ⋮ | | |
| | Aspiration | ⋮ | | |

FIG. 7

| TRANSITION STATE | TRANSITION TYPE | PHONETIC UNIT | PITCH | | |
|---|---|---|---|---|---|
| Attack | Normal | a | P1 | STATE TRANSITION TIME LENGTH | TONE GENERATOR CONTROL INFORMATION |
| | | | P2 | STATE TRANSITION TIME LENGTH | TONE GENERATOR CONTROL INFORMATION |
| | | | ⋮ | ⋮ | ⋮ |
| | | i | P1 | | |
| | | | ⋮ | | |
| | | M | ⋮ | | |
| | | ⋮ | ⋮ | | |
| | Sexy | a | ⋮ | | |
| | | i | ⋮ | | |
| | | M | ⋮ | | |
| | | ⋮ | ⋮ | | |
| | Sharp | a | ⋮ | | |
| | | i | ⋮ | | |
| | | M | ⋮ | | |
| | | ⋮ | ⋮ | | |
| | Soft | a | ⋮ | | |
| | | i | ⋮ | | |
| | | M | ⋮ | | |
| | | ⋮ | ⋮ | | |
| | ⋮ | ⋮ | ⋮ | | |
| NtN | Normal | a | ⋮ | | |
| | | ⋮ | ⋮ | | |
| | ⋮ | ⋮ | ⋮ | | |
| Release | Normal | a | ⋮ | | |
| | | ⋮ | ⋮ | | |
| | ⋮ | ⋮ | ⋮ | | |

*FIG. 8*

| VIBRATO TYPE | PHONETIC UNIT | PITCH | |
|---|---|---|---|
| Normal | a | P1 | TONE GENERATOR CONTROL INFORMATION |
| | | P2 | TONE GENERATOR CONTROL INFORMATION |
| | | ⋮ | ⋮ |
| | i | P1 | |
| | | ⋮ | |
| | M | ⋮ | |
| | ⋮ | ⋮ | |
| Sexy | a | ⋮ | |
| | i | ⋮ | |
| | M | ⋮ | |
| | ⋮ | ⋮ | |
| ⋮ | ⋮ | ⋮ | |
| Enka | a | ⋮ | |
| | i | ⋮ | |
| | M | ⋮ | |
| | ⋮ | ⋮ | |

FIG. 14

| ITEMS OF PHONETIC UNIT TRACK $T_p$ | INFORMATION | CONTENTS | EXPLANATION |
|---|---|---|---|
| Sil | Begin Time | T11 | STARTING TIME |
| | Duration | D11 | DURATION TIME |
| | PhU | Sil | PHONETIC UNIT |
| Sil_s | Begin Time | T12 | STARTING TIME |
| | Duration | D12 | DURATION TIME |
| | PhU1, PhU2 | Sil, s | PHONETIC UNIT |
| s_a | Begin Time | T13 | STARTING TIME |
| | Duration | D13 | DURATION TIME |
| | PhU1, PhU2 | s, a | PHONETIC UNIT |
| a | Begin Time | T14 | STARTING TIME |
| | Duration | D14 | DURATION TIME |
| | PhU | a | PHONETIC UNIT |

*FIG. 15*

| ITEMS OF TRANSITION TRACK TR | INFORMATION | CONTENTS | EXPLANATION |
|---|---|---|---|
| NONE | Begin Time | T21 | STARTING TIME |
| | Duration | D21 | DURATION TIME |
| | Index | NONE | TRANSITION INDEX |
| Attack | Begin Time | T22 | STARTING TIME |
| | Duration | D22 | DURATION TIME |
| | Index | Attack | TRANSITION INDEX |
| | Type | Type22 | TYPE OF TRANSITION INDEX |
| NONE | Begin Time | T23 | STARTING TIME |
| | Duration | D23 | DURATION TIME |
| | Index | NONE | TRANSITION INDEX |
| NtN | Begin Time | T24 | STARTING TIME |
| | Duration | D24 | DURATION TIME |
| | Index | NtN | TRANSITION INDEX |
| | Type | Type24 | TYPE OF TRANSITION INDEX |
| NONE | Begin Time | T25 | STARTING TIME |
| | Duration | D25 | DURATION TIME |
| | Index | NONE | TRANSITION INDEX |
| Release | Begin Time | T26 | STARTING TIME |
| | Duration | D26 | DURATION TIME |
| | Index | Release | TRANSITION INDEX |
| | Type | Type26 | TYPE OF TRANSITION INDEX |

FIG. 16

| ITEMS OF VIBRATO TRACK $T_B$ | INFORMATION | CONTENTS | EXPLANATION |
|---|---|---|---|
| Vibrato OFF | Begin Time | T31 | STARTING TIME |
| | Duration | D31 | DURATION TIME |
| | Index | OFF | INDEX |
| Vibrato ON | Begin Time | T32 | STARTING TIME |
| | Duration | D32 | DURATION TIME |
| | Index | ON | INDEX |
| | Type | Type32 | TYPE OF VIBRATO |
| Vibrato OFF | Begin Time | T33 | STARTING TIME |
| | Duration | D33 | DURATION TIME |
| | Index | OFF | INDEX |

CONSONANT + VOWEL

CONSONANT + VOWEL

CONSONANT
(NASAL SOUND, HALF VOWEL) + VOWEL

CONSONANT
(NASAL SOUND, HALF VOWEL) + VOWEL

VOWEL ALONE
CONSONANT (NASAL SOUND) ALONE

PRIOR ART

SINGING VOICE-SYNTHESIZING METHOD AND APPARATUS AND STORAGE MEDIUM

CROSS-REFERENCE TO RELATED APPLICATIONS

This application is a divisional application of U.S. patent application Ser. No. 10/034,352, filed Dec. 27, 2001, now U.S. Pat. No. 7,125,084, issued Oct. 17, 2006.

BACKGROUND OF THE INVENTION

1. Field of the Invention

This invention relates to a singing voice-synthesizing method and apparatus for synthesizing singing voices based on performance data being input in real time, and a storage medium storing a program for executing the method.

2. Description of Related Art

Conventionally, a singing voice-synthesizing method of the above-mentioned kind has been proposed which makes the rise time of a phoneme to be sounded first (first phoneme) in accordance with a note-on signal based on performance data shorter than the rise time of the same phoneme when it is sounded in succession to another phoneme during the note-on period (see e.g. Japanese Laid-Open Patent Publication (Kokai) No. 10-49169).

FIG. 40A shows consonant singing-starting timing and vowel singing-starting timing of human singing, and this example shows a case in which words of a song, "sa"-"i"-"ta", are sung at the respective pitches of "$C_3$(do)", "$D_3$(re)", and "$E_3$(mi)". In FIG. 40A, phonetic units each formed by a combination of a consonant and a vowel, such as "sa" and "ta", are produced such that the consonant starts to be sounded earlier than the vowel.

On the other hand, FIG. 40B shows singing-starting timing of singing voices synthesized by the above-described conventional singing voice-synthesizing method. In this example, the same words of the lyric as in FIG. 40A are sung. Actual singing-starting time points T1 to T3 indicate respective starting time points at which singing voices start to be generated in response to respective note-on signals. According to the conventional method, when the singing voice of "sa" is generated, the singing-starting time point of the consonant "s" is set equal to or coincident with the actual singing-starting time point T1, and the amplitude level of the consonant "s" is rapidly increased from the time point T1 so as to avoid giving an impression of the singing voice being delayed compared with instrument sound (accompaniment sound).

The conventional singing voice-synthesizing method suffers from the following problems:

(1) The vowel singing-starting time points of the human singing shown in FIG. 40A approximately corresponds to the actual singing-starting time points (note-on time points) in the singing voice synthesis shown in FIG. 40B. However, in the case of FIG. 40B, the consonant singing-starting time points are set equal to the respective note-on time points, and at the same time the rise time of each consonant (first phoneme) is shortened, so that compared with the FIG. 40A case, the singing-starting timing and singing duration time become unnatural.

(2) Information of a phonetic unit is transmitted immediately before a note-on time point of the phonetic unit, and the singing voice corresponding to the information of the phonetic unit starts to be generated at the note-on time point. Therefore, it is impossible to start generation of the singing voice earlier than the note-on time point.

(3) The singing voice is not controlled in respect of state transitions, such as an attack (rise) portion, and a release (fall) portion. This makes it impossible to synthesize more natural singing voices.

(4) The singing voice is not controlled in respect effects, such as vibrato. This makes it impossible to synthesize more natural singing voices.

BRIEF SUMMARY OF THE INVENTION

It is an object of the present invention to provide a singing voice-synthesizing method and apparatus which is capable of synthesizing natural singing voices close to human singing voices based on performance data being input in real time, and a storage medium storing a program for executing the method.

To attain the above object, according to a first aspect of the invention, there is provided a singing voice-synthesizing method comprising the steps of inputting phonetic unit information representative of a phonetic unit, time information representative of a singing-starting time point, and singing length information representative of a singing length, in timing earlier than the singing-starting time point, for a singing phonetic unit including a sequence of a first phoneme and a second phoneme, generating a phonetic unit transition time length formed by a generation time length of the first phoneme and a generation time length of the second phoneme, based on the inputted phonetic unit information, determining a singing-starting time point and a singing duration time of the first phoneme and a singing-starting time point and a singing duration time of the second phoneme, based on the generated phonetic unit transition time length, the inputted time information and singing length information, and starting generation of a first singing voice and a second singing voice formed by the first phoneme and the second phoneme at the singing-starting time point of the first phoneme and the singing-starting time point of the second phoneme, respectively, and continuing generation of the first singing voice and the second singing voice for the singing duration time of the first phoneme and the singing duration time of the second phoneme, respectively.

Preferably, the determining step includes setting the singing-starting time point of the first phoneme to a time point earlier than the singing-starting time point represented by the time information.

According to this singing voice-synthesizing method, the phonetic unit information, the time information, and the singing length information are inputted in timing earlier than the singing-starting time point represented by the time information, and a phonetic unit transition time length is formed based on the phonetic unit information. Further, a singing-starting time point and a singing duration time of the first phoneme and a singing-starting time point and a singing duration time of the second phoneme are determined based on the generated phonetic unit transition time length. As a result, as to the first and second phonemes, it is possible to determine desired singing-starting time points before or after the singing-starting time point represented by the time information, or determine singing duration times different from the singing length represented by the singing length information, whereby natural singing sounds can be produced as the first and second singing phonetic units. For example, if the singing-starting time point of the first phoneme can be set to a time point earlier than the singing-starting time point represented by the time information, it is possible to make the rise of a consonant sufficiently earlier than the rise of a vowel to thereby synthesize singing voices close to human singing voices.

To attain the above object, according to a second aspect of the invention, there is provided a singing voice-synthesizing method comprising the steps of inputting phonetic unit information representative of a phonetic unit, time information representative of a singing-starting time point, and singing length information representative of a singing length, for a singing phonetic unit, generating a state transition time length corresponding to a rise portion, a note transition portion, or a fall portion of the singing phonetic unit, based on the inputted phonetic unit information, and generating a singing voice formed by the phonetic unit, based on the phonetic unit information, the time information, and the singing length information which have been inputted, the generating step including adding a change in at least one of pitch and amplitude to the singing voice during a time period corresponding to the generated state transition time length.

According to this singing voice-synthesizing method, the state transition time length is generated based on the inputted phonetic unit, and a change in at least one of pitch and amplitude is added to the singing voice during a time period corresponding to the generated state transition time length. This makes it possible to synthesize natural singing voices with feelings of attack, note transition, or release.

To attain the above object, according to a third aspect of the invention, there is provided a singing voice-synthesizing apparatus comprising an input section that inputs phonetic unit information representative of a phonetic unit, time information representative of a singing-starting time point, and singing length information representative of a singing length, in timing earlier than the singing-starting time point, for a phonetic unit including a sequence of a first phoneme and a second phoneme, a storage section that stores a phonetic unit transition time length formed by a generation time length of the first phoneme and a generation time length of the second phoneme, a readout section that reads out the phonetic unit transition time length from the storage section based on the phonetic unit information inputted by the input section, a calculating section that calculates a singing-starting time point and a singing duration time of the first phoneme, and a singing-starting time point and a singing duration time of the second phoneme, based on the phonetic unit transition time length read by the readout section and the time information and the singing length information which have been inputted by the input section, and a singing voice-synthesizing section that starts generation of a first singing voice and a second singing voice formed by the first phoneme and the second phoneme at the singing-starting time point of the first phoneme and the singing-starting time point of the second phoneme calculated by the calculating section, respectively, and continuing generation of the first singing voice and the second singing voice for the singing duration time of the first phoneme and the singing duration time of the second phoneme calculated by the calculating section, respectively.

This singing voice-synthesizing apparatus implements the singing sound-synthesizing method according to the first aspect of the invention, and hence the same advantageous effects described as to this method can be obtained. Further, since the apparatus is configured such that the phonetic unit transition time length is read from the storage section, the construction of the apparatus or the processing executed thereby can be simple even if the number of singing phonetic units is increased.

Preferably, the input section inputs modifying information for modifying the generation time length of the first phoneme, and the calculating section modifies the generation time length of the first phoneme in the phonetic unit transition time length read by the readout section according to the modifying information inputted by the input section, and then calculates the singing-starting time point and the singing duration time of the first phoneme and the singing-starting time point and the singing duration time of the second phoneme, based on the phonetic unit transition time length including the modified generation time length of the first phoneme.

According to this preferred embodiment, it is possible to reflect the operator's intention on the singing-starting time points and singing duration times of the first and second phonemes, and hence synthesize more natural singing voices.

To attain the above object, according to a fourth aspect of the invention, there is provided a singing voice-synthesizing apparatus comprising an input section that inputs phonetic unit information representative of a phonetic unit, time information representative of a singing-starting time point, and singing length information representative of a singing length, for a singing phonetic unit, a storage section that stores state transition time lengths corresponding to a rise portion, a note transition portion, or a fall portion of the singing phonetic unit, a readout section that reads out the state transition time length from the storage section based on the phonetic unit information inputted by the input section, and a singing voice-synthesizing section that generates a singing voice formed by the phonetic unit, based on the phonetic unit information, the time information, and the singing length information which have been inputted by the input section, the singing voice-synthesizing section adding a change in at least one of pitch and amplitude to the singing voice during a time period corresponding to the state transition time length read out by the readout section.

This singing voice-synthesizing apparatus implements the singing sound-synthesizing method according to the second aspect of the invention, and hence the same advantageous effects described as to this method can be obtained. Further, since the apparatus is configured such that the state transition time length is read from the storage section, the construction of the apparatus or the processing executed thereby can be simple even if the number of singing phonetic units is increased.

Preferably, the input section inputs modifying information for modifying the state transition time lengths, and the singing voice-synthesizing apparatus includes a modifying section that modifies the corresponding state transition time length read out by the readout section based on the modifying information inputted by the input section, the singing voice-synthesizing section adding a change in at least one of pitch and amplitude to the singing voice during a time period corresponding to the state transition time length modified by the modifying section.

According to this preferred embodiment, it is possible to reflect the operator's intention on the state transition time length, and hence synthesize more natural singing voices.

To attain the above object, according to a fifth aspect of the invention, there is provided a singing sound-synthesizing apparatus comprising an input section that inputs phonetic unit information representative of a phonetic unit, time information representative of a singing-starting time point, singing length information representative of a singing length, and effects-imparting information, for a singing phonetic unit, and a singing voice-synthesizing section that generates a singing voice formed by the phonetic unit, based on the phonetic unit information, the time information, and the singing length information which have been inputted by the input section, the singing voice synthesizing section imparting effects to the singing voice based on the effects-imparting information inputted by the input section.

According to this singing voice-synthesizing apparatus, it is possible to add minute changes in pitch and amplitude, e.g. those in vibrato effect, to singing voices, whereby more natural singing voices can be synthesized.

Preferably, the effects-imparting information inputted by the input section represents an effects-imparting time period, and the singing voice-synthesizing apparatus further comprises a setting section that sets a new effects-imparting time period corresponding to both the effects-imparting time period represented by the effects-imparting information and a second effects-imparting time period of a singing phonetic unit preceding the singing phonetic unit if the effects-imparting time period is continuous from the second effects-imparting time period, the singing voice-synthesizing section imparting effects to the singing voice during the new effects-imparting time period set by the setting section.

According to this preferred embodiment, since effects are imparted by setting a new effects-imparting time period corresponding to effects imparting-time periods continuous to each other, effects are not interrupted to improve the continuity thereof.

To attain the above object, according to a sixth aspect of the invention, there is provided a singing voice-synthesizing apparatus comprising an input section that inputs phonetic unit information representative of a phonetic unit, time information representative of a singing-starting time point, and singing length information representative of a singing length, for a singing phonetic unit, in timing earlier than the singing-starting time point, a setting section that randomly sets a new singing-starting time point, within a predetermined time range extending before and after the singing-starting time point, based on the time information inputted by the input section, and a singing voice-synthesizing section that generates a singing voice formed by the phonetic unit, based on the phonetic unit information and the singing length information which have been inputted by the input section, and the singing-starting time point set by the setting section, the singing voice synthesizing section starting generation of the singing sound at the new singing-starting time point set by the setting section.

According to this singing voice-synthesizing apparatus, a new singing-starting time point is randomly set within a predetermined time range extending before and after the singing-starting time point represented by the time information, and a singing voice is generated at the set singing-starting time point. This makes it possible to synthesize more natural singing voices with variations in singing-starting timing.

To attain the above object, there is provided a storage medium storing a program for executing the singing voice-synthesizing method according to the first aspect of the invention.

Similarly, there is provided a storage medium storing a program for executing the singing voice-synthesizing method according to the second aspect of the invention.

The above and other objects, features and advantages of the present invention will become more apparent from the following detailed description taken in conjunction with the accompanying drawings.

BRIEF DESCRIPTION OF THE DRAWINGS

FIG. 4 is a diagram showing information stored in performance data;

FIG. 5 is a diagram showing information stored in a phonetic unit database (DB);

FIGS. 6A and 6B are diagrams showing information stored in a phonetic unit transition DB;

FIG. 7 is a diagram showing information stored in a state transition DB;

FIG. 8 is a diagram showing information stored in a vibrato DB;

FIG. 14 is a diagram useful in explaining various items in a phonetic unit track in FIG. 13;

FIG. 15 is a diagram useful in explaining various items in a transition track in FIG. 13;

FIG. 16 is a diagram useful in explaining various items in a vibrato track in FIG. 13;

DETAILED DESCRIPTION OF THE INVENTION

The present invention will now be described in detail with reference to the drawings showing a preferred embodiment thereof.

Figure 1A:
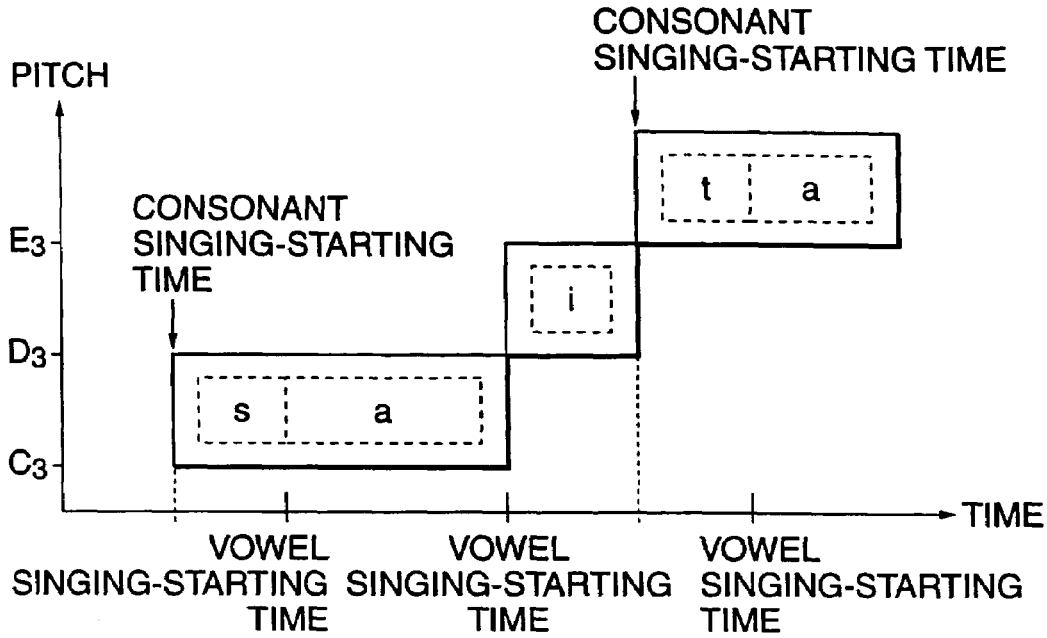
FIGS. 1A and 1B show singing-starting timing of human singing, and singing-starting timing of a singing voice synthesized by a singing voice-synthesizing method according to the present invention, for comparison.
Figure 1B:
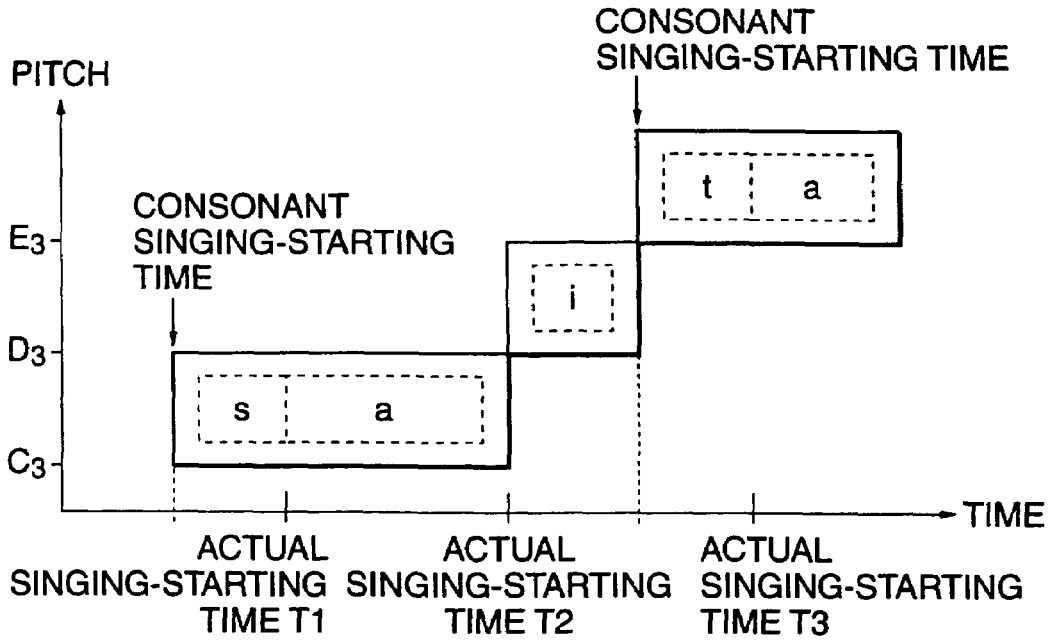
Figure 40A:
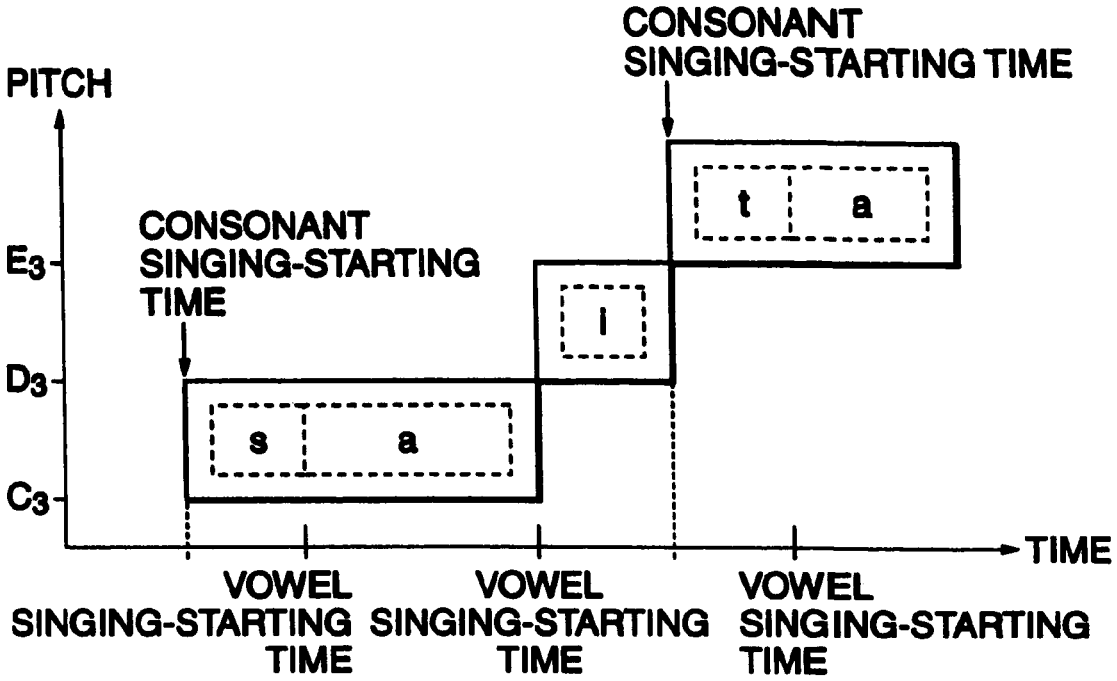
FIGS. 40A and 40B show singing-starting timing of human singing, and singing-starting timing of singing voices synthesized according to the prior art, respectively, for comparison.
Figure 40B:
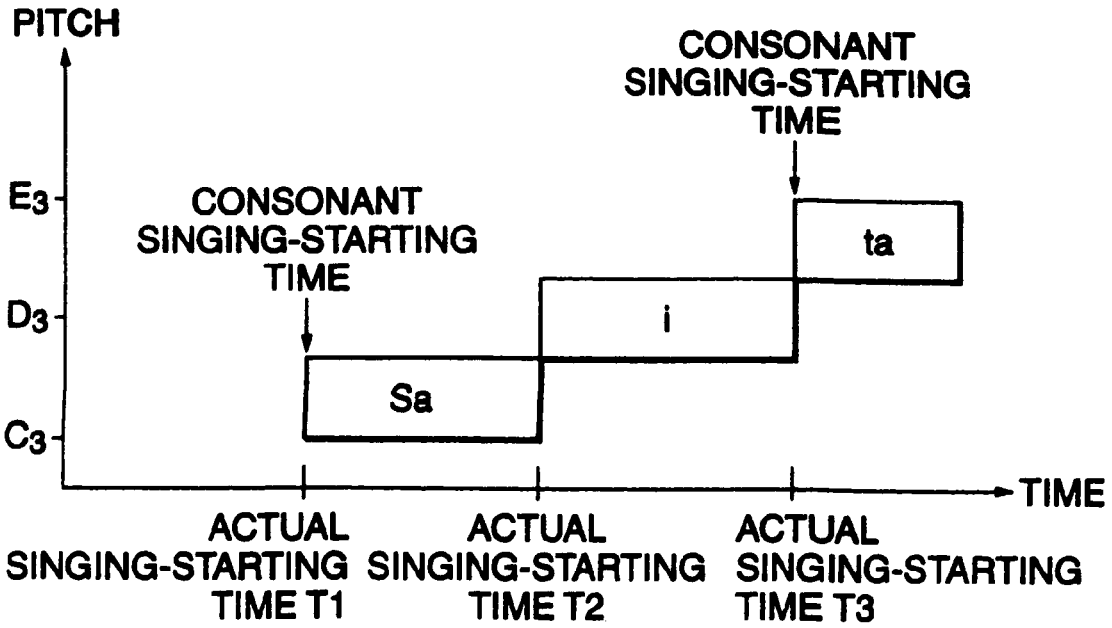
PRIOR ART FIG. 40B

Referring first to FIGS. 1A and 1B, the outline of a singing voice-synthesizing method according to an embodiment of the present invention will be described. FIG. 1A shows consonant singing-starting timing and vowel singing-starting timing of human singing, similarly to FIG. 40A, while FIG. 1B shows singing-starting timing of singing voices synthesized by the singing voice-synthesizing method according to the present embodiment.

In the present embodiment, performance data which is comprised of phonetic unit information, singing-starting time information, and singing length information is inputted for each of phonetic units which constitute a lyric such as "saita", each phonetic unit consisting of "sa", "i", or "ta". The singing-starting time information represents an actual singing-starting time point (e.g. timing of a first beat of a time), such as T1 shown in FIG. 1B. Each performance data is inputted in timing earlier than the actual singing-starting time point, and has its phonetic unit information converted to a phonetic unit transition time length. The phonetic unit transition time length consists of a first phoneme generation time length and a second phoneme generation time length, for a phonetic unit, e.g. "sa", formed by a first phoneme ("s") and a second phoneme ("a"). This phonetic unit transition time, the singing-starting time information, and the singing length information are used to determine the respective singing-starting time points of the first and second phonemes and the respective singing duration times of the first and second phonemes. At this time, the singing-starting time point of the consonant "s" is set to be earlier than the actual singing-starting time point T1. This also applies to the phonetic unit "ta". The singing-starting time point of the vowel "a" is set equal to or earlier or later than the actual singing-starting time point T1. This also applies to the phonetic units "i" and "ta". In the FIG. 1B example, for the phonetic unit "sa", the singing-starting time point of the consonant "s" is set earlier than the actual singing-starting time point T1 so as to be adapted to the FIG. 1A case of human singing, and the singing-starting time point of the vowel "a" is set equal to the actual singing-starting time point T1 for the phonetic unit "i", the singing-starting time point thereof is set to the actual singing-starting time point T2; and for the phonetic unit "ta", the singing-starting time point of the consonant "t" is set earlier than the actual singing-starting time point T3 so as to be adapted to the FIG. 1A case of human singing, and the singing-starting time point of the vowel "a" is set equal to the actual singing-starting time point T3.

In the singing voice synthesis, the consonant "s" starts to be generated at the determined singing-starting time point and continues to be generated over the determined singing duration time. This also applies to the phonetic units "i" and "ta". As a result, the singing voices synthesized by the present method become very natural in which the singing-starting time points and the singing duration times thereof are approximate to those of the FIG. 1A case of human singing.

Figure 2:
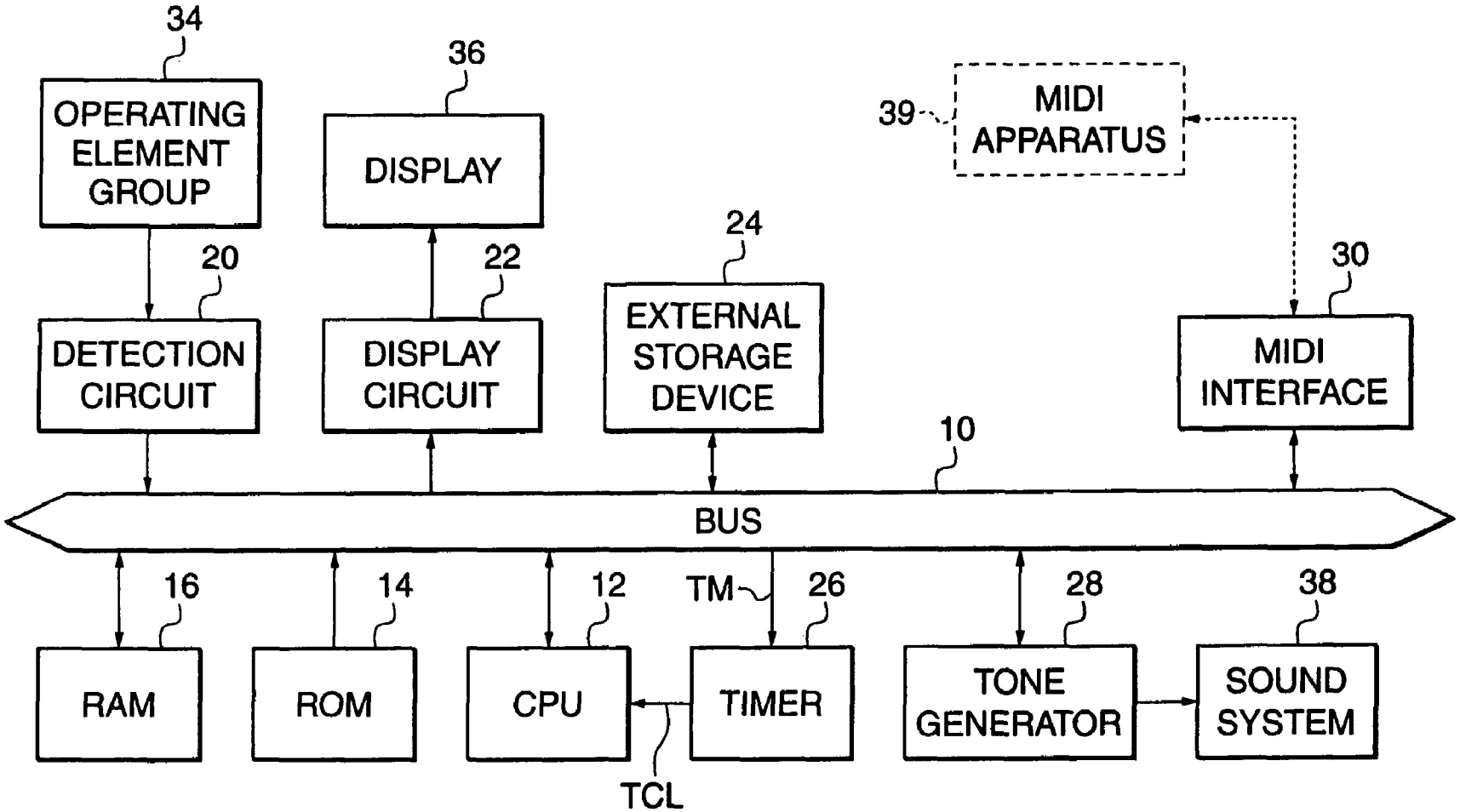
FIG. 2 is a block diagram showing the circuit configuration of a singing voice-synthesizing apparatus according to an embodiment of the present invention.

FIG. 2 shows the circuit configuration of a singing voice-synthesizing apparatus according to an embodiment of the present invention. This singing voice-synthesizing apparatus has its operation controlled by a small-sized computer.

The singing voice-synthesizing apparatus is comprised of a CPU (Central Processing Unit) 12, a ROM (Read Only Memory) 14, a RAM (Random Access Memory) 16, a detection circuit 20, a display circuit 22, an external storage device 24, a timer 26, a tone generator circuit 28, and a MIDI (Musical Instrument Digital Interface) interface 30, all connected to each other via a bus 10.

The CPU 12 performs operations of various processes concerning the generation of musical tones, the synthesis of singing voices, etc. according to programs stored in the ROM 14. The process concerning the synthesis of singing voices (singing voice-synthesizing process) will be described in detail hereinafter with reference to flowcharts shown in FIG. 17 etc.

The RAM 16 includes various storage sections used as working areas for processing operations of the CPU 12, and is provided with a receiving buffer in which received performance data are written, etc. as a storage section related to the execution of the present invention.

The detection circuit 20 detects operating information concerning operations of various operating elements of an operating element group 34 arranged on a panel, not shown.

The display circuit 22 controls the operation of a display 36 to thereby enable various images to be displayed thereon.

The external storage device 24 is comprised of a drive in which at least one type of storage medium, e.g. a HD (hard disk), an FD (floppy disk), a CD (compact disk), a DVD (digital versatile disk), and an MO (magneto-optical disk) can be removably mounted. When a desired storage medium is mounted in the external storage device 24, data can be transferred from the storage medium to the RAM 16. Further, when the storage medium is a writable one, such as a HD and an FD, data can be transferred from the RAM 16 to the storage medium.

As program-recording means, there may be employed a storage medium mounted in the external storage section 24 instead of the ROM 14. In this case, a program stored in the storage medium is transferred from the storage medium 24 to the RAM 16. Then, the CPU 12 is operated according to the program stored in the RAM 16. This makes it possible to add a program or upgrade the same, with ease.

The timer 26 generates a tempo clock signal TCL having a repetition period corresponding to a tempo designated by tempo data TM, and the tempo clock signal TCL is supplied to the CPU 12 as an interrupt command. The CPU 12 carries out the singing voice synthesis by executing an interrupt-handling process in response to the tempo clock signal TCL. The tempo designated by the tempo data TM can be varied according to the operation of a tempo-setting operating element of the operating element group 34. The repetition period of generation of the tempo clock signal TCL can be set e.g. to 5 ms.

The tone generator circuit 28 includes a large number of tone-generating channels and a large number of singing voice-synthesizing channels. The singing voice-synthesizing channels synthesize singing voices based on a formant-synthesizing method. In the singing voice-synthesizing process, described hereinafter, singing voice signals are generated from the respective singing voice-synthesizing channels. The thus generated tone signals and/or singing voice signals are converted to sound or acoustic waves by a sound system 38.

The MIDI interface 30 is provided for MIDI communication between the present singing voice-synthesizing apparatus and an MIDI apparatus 39 provided as a separate unit. In the present embodiment, the MIDI interface 30 is used for receiving performance data from the MIDI apparatus 39, so as to synthesize singing voices. The singing voice-synthesizing apparatus may be configured such that performance data for accompaniment for singing may be received together with performance data for the singing voice synthesis from the MIDI apparatus 39, and the tone generator circuit 28 generates musical tone signals for the accompaniment based on the performance data for the accompaniment of singing, so that the sound system 38 generates accompaniment sounds.

Next, the outline of the singing voice-synthesizing process carried out by the singing voice-synthesizing apparatus according to the present embodiment will be described with reference to FIG. 3. In a step S40, performance data is inputted. More specifically, the performance data is received from the MIDI apparatus 39 via the MIDI interface 30. The details of the performance data will be described hereinafter with reference to FIG. 4.

In a step S42, based on each received performance data, a phonetic unit transition time length and a state transition time length are retrieved from a phonetic unit transition DB (database) 14*b* and a state transition DB (database) 14*c* within a singing voice synthesis DB (database) 14. Based on the phonetic unit transition time length, the state transition time length and the performance data, a singing voice synthesis score is formed. The singing voice synthesis score is comprised of three tracks of a phonetic unit track, a transition track, and a vibrato track. The phonetic unit track contains information of singing-starting time points, singing duration times, etc., the transition track contains information of starting time points and duration times of transition states, such as attack, and the vibrato track contains information of starting time points and duration times of a vibrato-added state, and the like.

In a step S44, the singing voice synthesis is performed by a singing voice-synthesizing engine. More particularly, the singing voice synthesis is carried out based on the performance data inputted in the step S40, the singing voice synthesis scores formed in the step S42, and tone generator control information retrieved from the phonetic unit DB 14*a*, the phonetic unit transition DB 14*b*, the state transition DB 14*c* and the vibrato DB 14*d*, whereby singing voice signals are generated in the order of voices to be sung. In the singing voice-synthesizing process, a singing voice formed by a single phonetic unit (e.g. "a") designated by the phonetic unit track or a transitional phonetic unit (e.g. "sa" in which transition from "s" to "a" occurs) and at the same time having pitch designated by the performance data starts to be generated at a singing-starting time point designated by the phonetic unit track and continues to be generated over a singing duration time designated by the phonetic unit track.

To the singing voice thus generated, minute changes in pitch, amplitude and the like can be added at and after the starting time of a transition state, such as attack, designated by the transition track, and the state in which such changes are added to the singing voice can be continued over a duration time of the transition state, such as attack, designated by the transition track. Further, to the singing voice, a vibrato can be added at and after a starting time designated by the vibrato track and the state in which the vibrato is added to the singing voice can be continued over a duration time designated by the vibrato track.

In steps S46 and S48, processes are carried out within the tone generator circuit 28. In the step S46, the singing voice signal is subjected to D/A (digital-to-analog) conversion, and in the step S48, the singing voice signal subjected to the D/A conversion is outputted to the sound system 38 to cause the same to be sounded as a singing voice.

FIG. 4 shows information contained in the performance data. The performance data contains performance information necessary for singing one syllable, and the performance information contains note information, phonetic unit track information, transition track information, and vibrato track information.

The note information contains note-on information indicative of an actual singing-starting time point, duration information indicative of actual singing length, and pitch information indicative of the pitch of singing voice. The phonetic unit track information contains information of a singing phonetic unit (denoted by PhU), consonant modification information representative of a singing consonant expansion/compression ratio, etc. In the present embodiment, it is assumed that the singing voice synthesis is carried out to synthesize singing voices of a Japanese-language song, and hence the phonemes appearing in the singing voices are consonants and vowels, and further, the phonetic unit state (PhU State) can be a combination of a consonant and a vowel, a vowel alone, or a voiced consonant (nasal sound, half vowel) alone. If the phonetic unit state is the voiced consonant alone, the singing-starting time point of the voiced consonant is similar to that of a vowel alone case, and hence the phonetic unit state is handled as the vowel alone.

The transition track information contains attack type information indicative of a singing attack type, attack rate information indicative of a singing attack expansion/compression ratio, release type information indicative of a singing release type, release rate information indicative of a singing release expansion/compression ratio, note transition type information indicative of a singing note transition type, etc. The attack type designated by the attack type information includes "normal", "sexy", "sharp", "soft", etc. The release type information and the note transition type information can also designate one of a plurality of types, similar to the attack type. The note transition means a transition from the present performance data (performance event) to the next performance data (performance event). The singing attack expansion/compression ratio, the singing release expansion/compression ratio, and the note transition expansion/compression ratio are each set to a value larger than 1 when the state transition time length associated therewith is desired to be increased, and to a value smaller than 1 when the same is desired to be decreased. These ratios can be also set to 1, and in this case, addition of minute changes in pitch, amplitude and the like accompanying the attack, release and note transition is not carried out.

The vibrato track information contains information of a vibrato number indicative of the number of vibrato events in the present performance data, information of vibrato delay 1 indicative of a delay time of a first vibrato, information of vibrato duration 1 indicative of a duration time of the first vibrato, information of vibrato delay K indicative of a delay time of a K-th vibrato, where K is equal to or larger than 2, information of vibrato duration K indicative of a duration time of the K-th vibrato, and information of vibrato type K indicative of a type of the K-th vibrato. When the number of vibrato events is 0, the information of vibrato delay 1, et seq. are not contained in the vibrato track information. The vibrato type designated by the information of vibrato type 1 to vibrato type K includes "normal", "sexy", and "enka (Japanese traditional popular song)".

Figure 3:
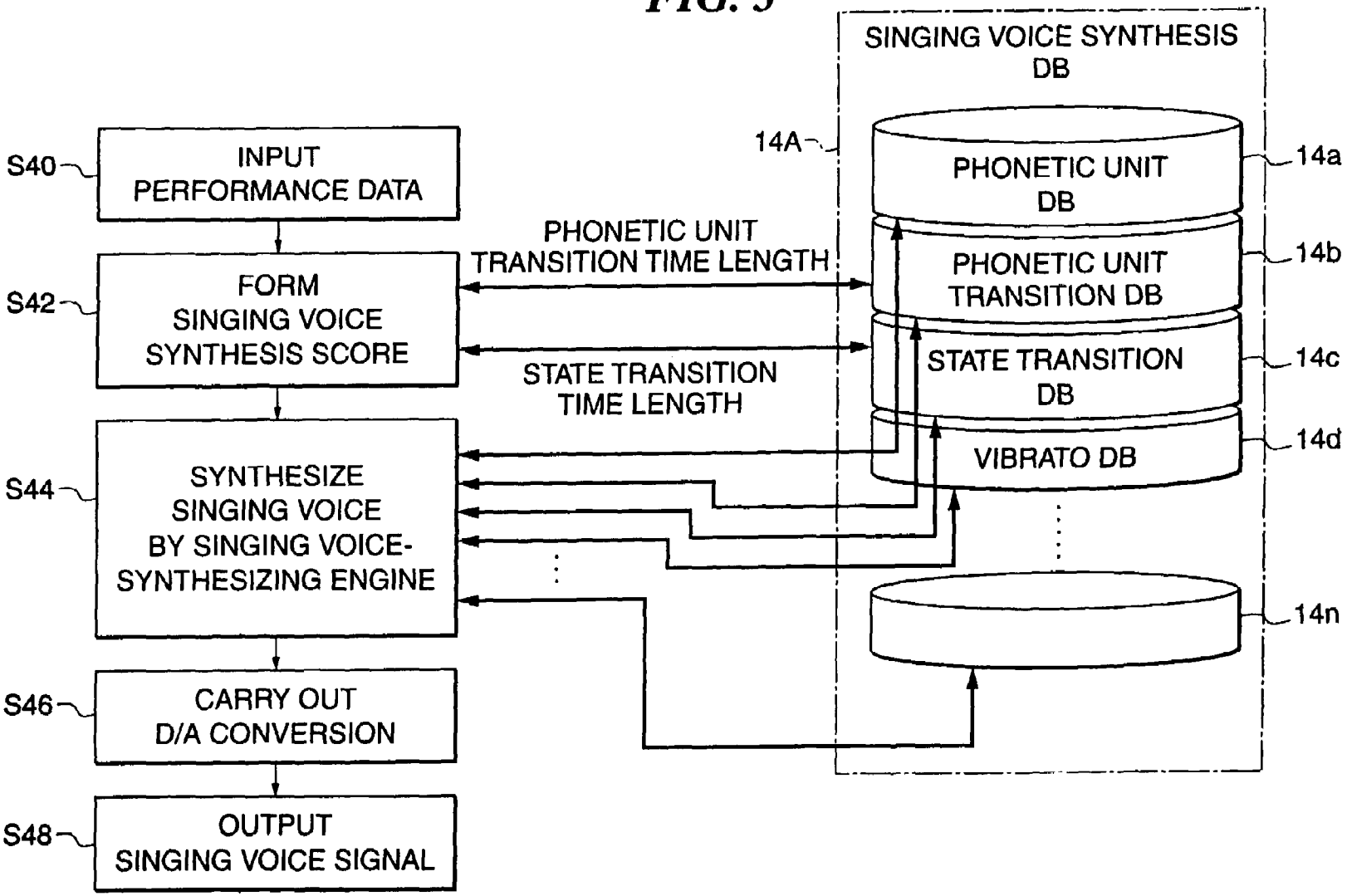
FIG. 3 is a flowchart useful in explaining the outline of a singing voice-synthesizing process executed by the FIG. 2 apparatus.

Although the singing voice synthesis DB 14A shown in FIG. 3 is provided within the ROM 14 in the present embodiment, this is not limitative, but the same may be provided in the external storage device 24 and transferred therefrom when it is used. Within the singing voice synthesis DB 14A, there are provided the phonetic unit DB 14*a*, the phonetic unit transition DB 14*b*, the state transition DB 14*c*, the vibrato DB 14*d*, . . . , another DB 14*n*.

Next, the information stored in the phonetic unit DB 14*a*, the phonetic unit transition DB 14*b*, the state transition DB 14*c*, and the vibrato DB 14*d* will be described with reference to FIGS. 5 to 8. The phonetic unit DB 14*a* and the vibrato DB 14*d* store tone generator control information as shown in FIGS. 5 and 8, respectively. The phonetic unit transition DB 14*b* stores phonetic unit transition time lengths and tone generator control information, as shown in FIG. 6B, and the state transition DB 14*c* stores state transition time lengths and tone generator control information, as shown in FIG. 7. When such storage information is prepared, singing voices of a singer are analyzed to determine tone generator control information, phonetic unit transition time lengths and state transition time lengths. Further, as to the types of "normal", "sexy", "soft", "enka", etc., singing voices are recorded by asking the singer to sing the song with the same type of tinged sound (e.g. by asking "Please sing by adding a sexy attack." or "Please sing by adding enka-tinged vibrato.), and the recorded singing voices are analyzed to determine the tone generation control information, the phonetic unit transition time lengths, the state transition time lengths for the specific type. The tone generator control information is comprised of formant frequency and control parameters of a formant level necessary for synthesizing desired singing voices.

The phonetic unit DB 14*a* shown in FIG. 5 stores tone generator control information for each pitch, such as "P1" and "P2" within each phonetic unit, such as "a", "i", "M", and "Sil". In FIGS. 5 to 8 and the following description, the symbol "M" represents a phonetic unit "u", and "Sil" represents silence. During the singing voice synthesis, the tone generator control information adapted to the phonetic unit and pitch of a singing voice to be synthesized is selected from the phonetic unit DB 14*a*.

FIG. 6A shows phonetic unit transition time lengths (a) to (f) stored in the phonetic unit transition DB 14*b*. In FIG. 6A and the following description, the symbols "V_Sil" etc. represent the following:

(a) "V_Sil" represents a phonetic unit transition from a vowel to silence, and, for example, in FIG. 6B, corresponds to a combination of the preceding vowel "a" and the following phonetic unit "Sil".

(b) "Sil_C" represents a phonetic unit transition from silence to a consonant, and, for example, in FIG. 6B, corresponds to a combination of the preceding phonetic unit "Sil" and the following consonant "s", not shown.

(c) "C_V" represents a phonetic unit transition from a consonant to a vowel, and, for example, in FIG. 6B, corresponds to a combination of the preceding consonant "s", not shown, and the following vowel "a", not shown.

(d) "Sil_V" represents a phonetic unit transition from silence to a vowel, and, for example, in FIG. 6B, corresponds to a combination of the preceding phonetic unit "Sil" and the following vowel "a".

(e) "pV_C" represents a phonetic unit transition from a preceding vowel to a consonant, and, for example, in FIG. 6B, corresponds to a combination of the preceding vowel "a" and the following consonant "s", not shown.

(f) "pV_V" represents a phonetic unit transition from a preceding vowel to a vowel, and, for example, in FIG. 6B, corresponds to a combination of the preceding vowel "a" and the following vowel "i".

The phonetic unit DB 14*b* shown in FIG. 6B stores a phonetic unit transition time length and tone generation control information for each pitch, such as "P1" and "P2" within each combination of phonetic units (i.e. transition in the phonetic units), such as "a"-"i". In FIG. 6B, "aspiration" represents a sound of aspiration. The phonetic unit transition time length consists of a combination of a time length of the preceding phonetic unit and a time length of the following phonetic unit, with the boundary between the two time lengths being held as time slot information. When the singing voice synthesis score is formed, a phonetic unit transition time length suitable for the combination of phonetic units which should form the phonetic track and the pitch thereof is selected from the phonetic unit transition DB 14*b*. Further, during the singing voice synthesis, tone generator control information suitable for the combination of phonetic units of a singing voice to be synthesized and the pitch thereof is selected from the phonetic unit transition DB 14*b*.

The state transition DB 14*c* shown in FIG. 7 stores a state transition time length and tone generator control information for each pitch, such as "P1" and "P2", within each phonetic unit, such as "a" and "i", for each of the state types, i.e. "normal", "sexy", "sharp" and "soft", within each of the transition states, i.e. attack, note transition (denoted as "NtN") and release. The state transition time length corresponds to a duration time of a transition state, such as attack, note transition and release. When the singing voice synthesis score is formed, a state transition time length suitable for the transition state, transition track, transition type, phonetic unit, and pitch of a singing voice to be synthesized, which should form the transition track, is selected from the state transition DB 14*c*.

The vibrato DB 14*d* shown in FIG. 8 stores tone generator control information for each pitch, such as "P1" and "P2", within each phonetic unit, such as "a" and "i", for each of the vibrato types, "normal", "sexy", . . . and "enka". When the singing voice synthesis score is formed, the tone generator control information suitable for the vibrato type, phonetic unit, and pitch of a singing voice to be synthesized is selected from the vibrato DB 14*d*.

Figure 9:
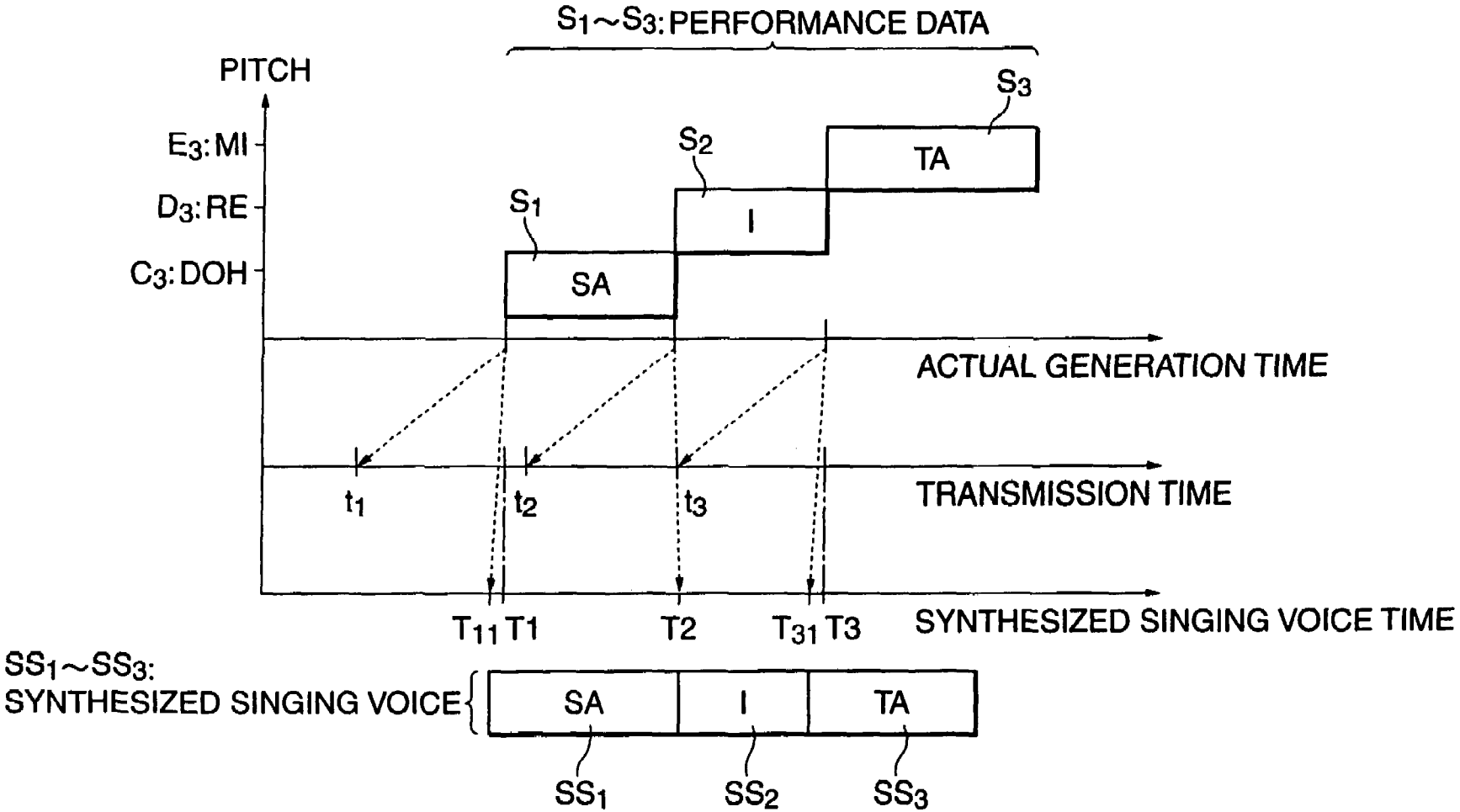
FIG. 9 is a diagram useful in explaining a process of singing voice synthesis based on performance data.

FIG. 9 illustrates a manner of singing voice synthesis based on performance data. Assuming that performance data $S_1$, $S_2$, and $S_3$ designates, similarly to FIG. 1B, "sa: $C_3$: T1 . . . " "i: $D_3$: T2 . . . ", and "ta: $E_3$: T3 . . . ", respectively, the performance data $S_1$, $S_2$, $S_3$ are transmitted at respective time points $t_1$, $t_2$, $t_3$ earlier than the actual singing-starting time points T1, T2, T3, and received via the MIDI interface 30. The process of transmitting/receiving the performance data corresponds to the process of inputting performance data in the step S40. Whenever each performance data is received, in the step S42, a singing voice synthesis score is formed for the performance data.

Then, in the step S44, according to the formed singing voice synthesis scores, singing voices $SS_1$, $SS_2$, $SS_3$ are synthesized. As a result of the singing voice synthesis, it is possible to start generation of the consonant "s" of the singing voice $SS_1$ at a time point $T_{11}$ earlier than the time point T1, and further the vowel "a" of the singing voice $SS_1$ at the time point T1. Also, it is possible to start generation of the vowel "i" of the singing voice $SS_2$ at the time point T2. Further, it is possible to start generation of the consonant "t" of the singing voice $SS_3$ at a time point $T_3$, earlier than the time point T3, and further the vowel "a" of the singing voice $SS_3$ at the time point T3. If desired, it is also possible to start generation of the vowel "a" of the phonetic unit "sa" or the vowel "i" of the phonetic unit "i" earlier than the respective time points T1 and T2.

Figure 10:
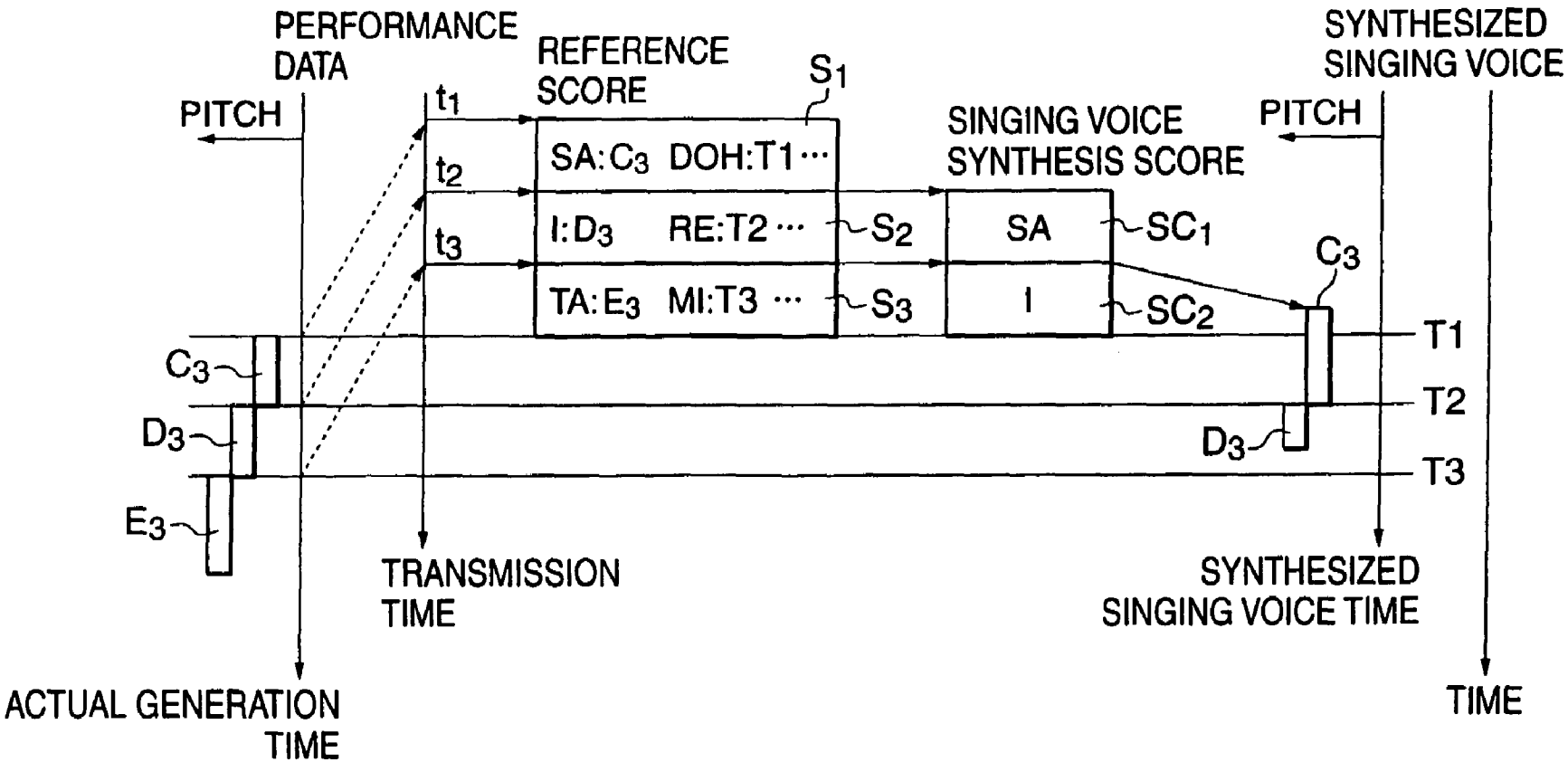
FIG. 10 is a diagram showing a state of a reference score and a singing voice synthesis score being formed.

FIG. 10 illustrates a procedure of generation of reference scores and singing voice synthesis scores in the step S42. In the present embodiment, a reference score-forming process is carried out as preprocessing prior to the singing voice synthesis score-forming process. More specifically, performance data transmitted at the time points $t_1$, $t_2$, $t_3$ are sequentially received and written into the receiving buffer within the RAM 16. From the receiving buffer, the performance data are transferred to a storage section, referred to as "reference score", within the RAM 16, in the order of actual singing-starting time points designated by the performance data, and sequentially written thereinto, e.g. in the order of performance data $S_1$, $S_2$, $S_3$. Then, singing voice synthesis scores are formed in the order of actual singing-starting time points based on the performance data in the reference score. For example, based on the performance data $S_1$, a singing voice synthesis score $SC_1$ is formed, and based on the performance data $S_2$, a singing voice synthesis score $SC_2$ is formed. Thereafter, as described hereinbefore with reference to FIG. 9, the singing voice synthesis is carried out according to the singing voice synthesis scores $SC_1$, $SC_2$, . . .

Figure 11:
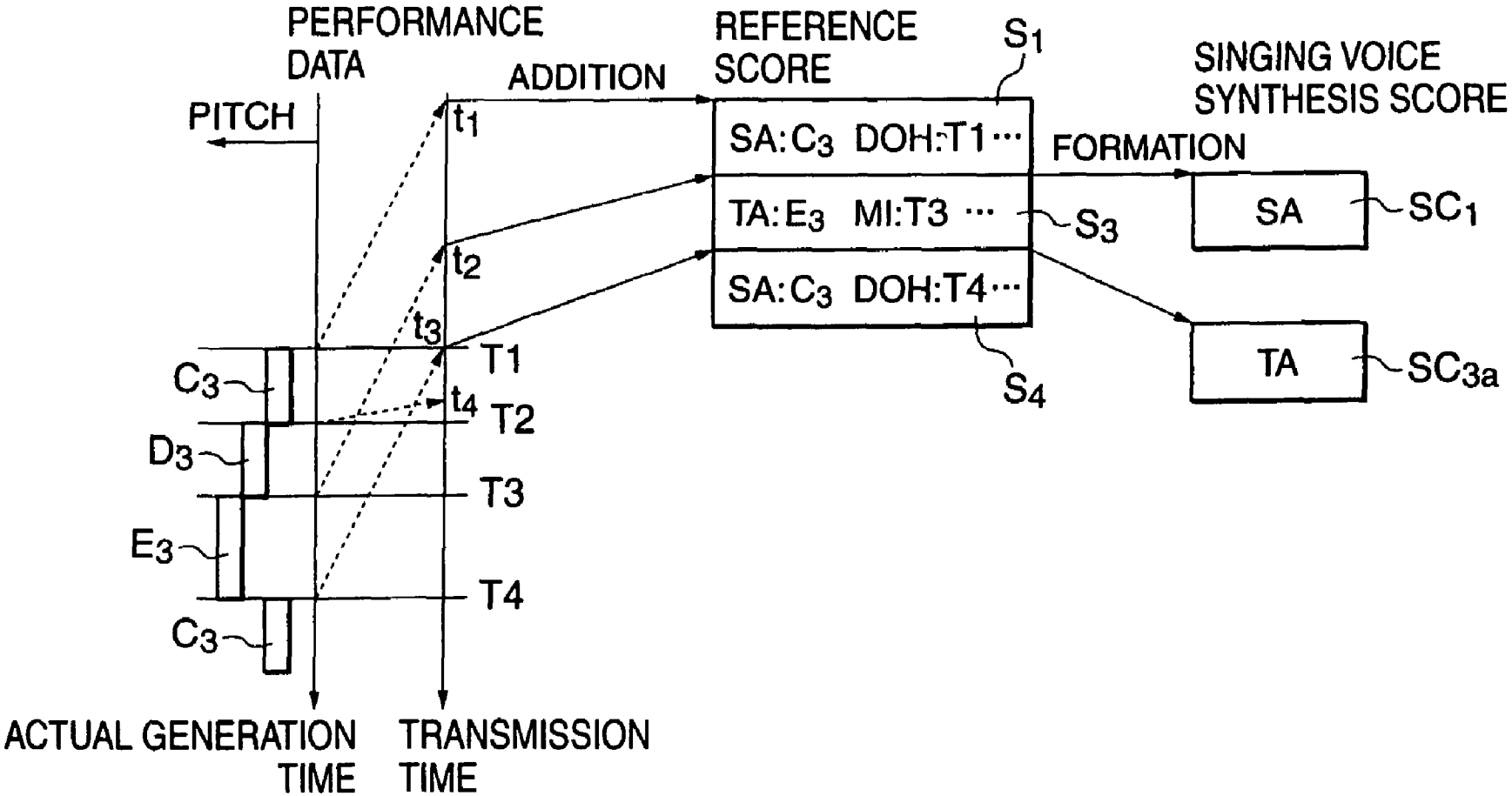
FIG. 11 is a diagram showing a manner of forming a singing voice synthesis score when performance data is added to the reference score.
Figure 12:
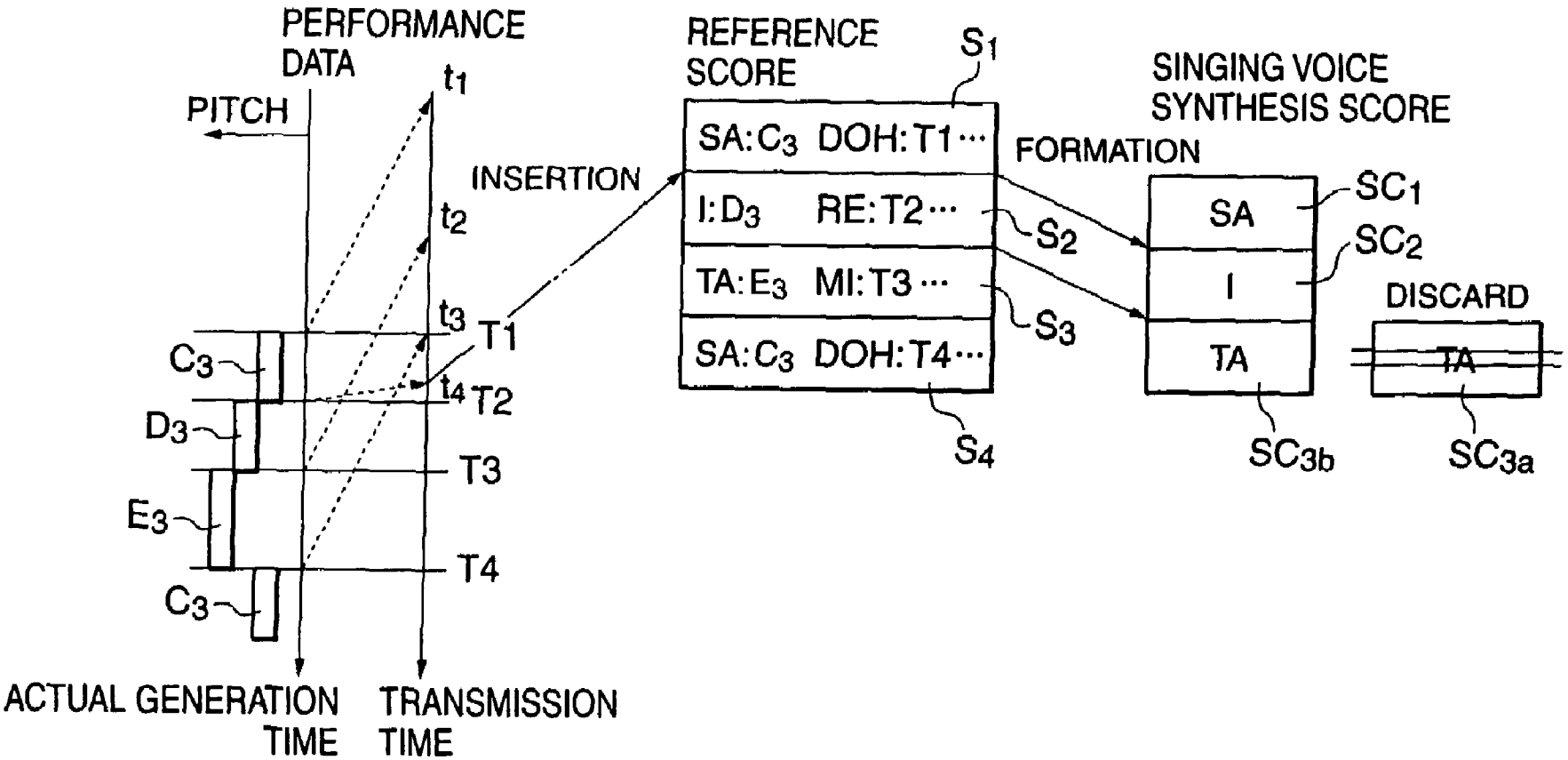
FIG. 12 is a diagram showing a manner of forming the singing voice synthesis score when performance data is inserted into the reference score.

The above description concerns the processes of forming reference scores and singing voice synthesis scores when the transmission and reception of performance data are carried out in the order of actual singing-starting time points. When the transmission and reception of performance data are not carried out in the order of actual singing-starting time points, reference scores and singing voice synthesis scores are formed in manners as illustrated in FIGS. 11 and 12. More specifically, it is assumed that performance data $S_1$, $S_3$, $S_4$ are transmitted at respective time points $t_1$, $t_2$, $t_3$, and sequentially received, as shown in FIG. 11. Then, after the performance data $S_1$ is written into the reference score, the performance data $S_3$ and $S_4$ are sequentially written thereinto, and based on the performance data $S_1$, $S_3$, singing voice synthesis scores $SC_1$, $SC_{3a}$ are respectively formed. The writing of performance data into the reference score at a second or later time point will be referred to as "addition" if they are simply written into the reference score in an adding fashion as illustrated in FIGS. 10 and 11, while the same will be referred to as "insertion" if they are written in an inserting fashion as illustrated in FIG. 12. Assuming that thereafter, at a time point t4, performance data $S_2$ is transmitted and received, as shown in FIG. 12, the performance data $S_2$ is added between the performance data $S_1$ and $S_3$ within the reference score. The reference score(s) after the actual singing-starting time point at which the insertion of performance data has occurred is/are discarded, and based on the performance data thus updated after the actual singing-starting time point at which the insertion of performance data has occurred, new singing voice synthesis scores are formed. For example, the singing voice synthesis score $SC_{3a}$ is discarded, and based on the performance data $S_2$, $S_3$, singing voice synthesis scores $SC_2$, $SC_{3b}$ are formed, respectively.

Figure 13:
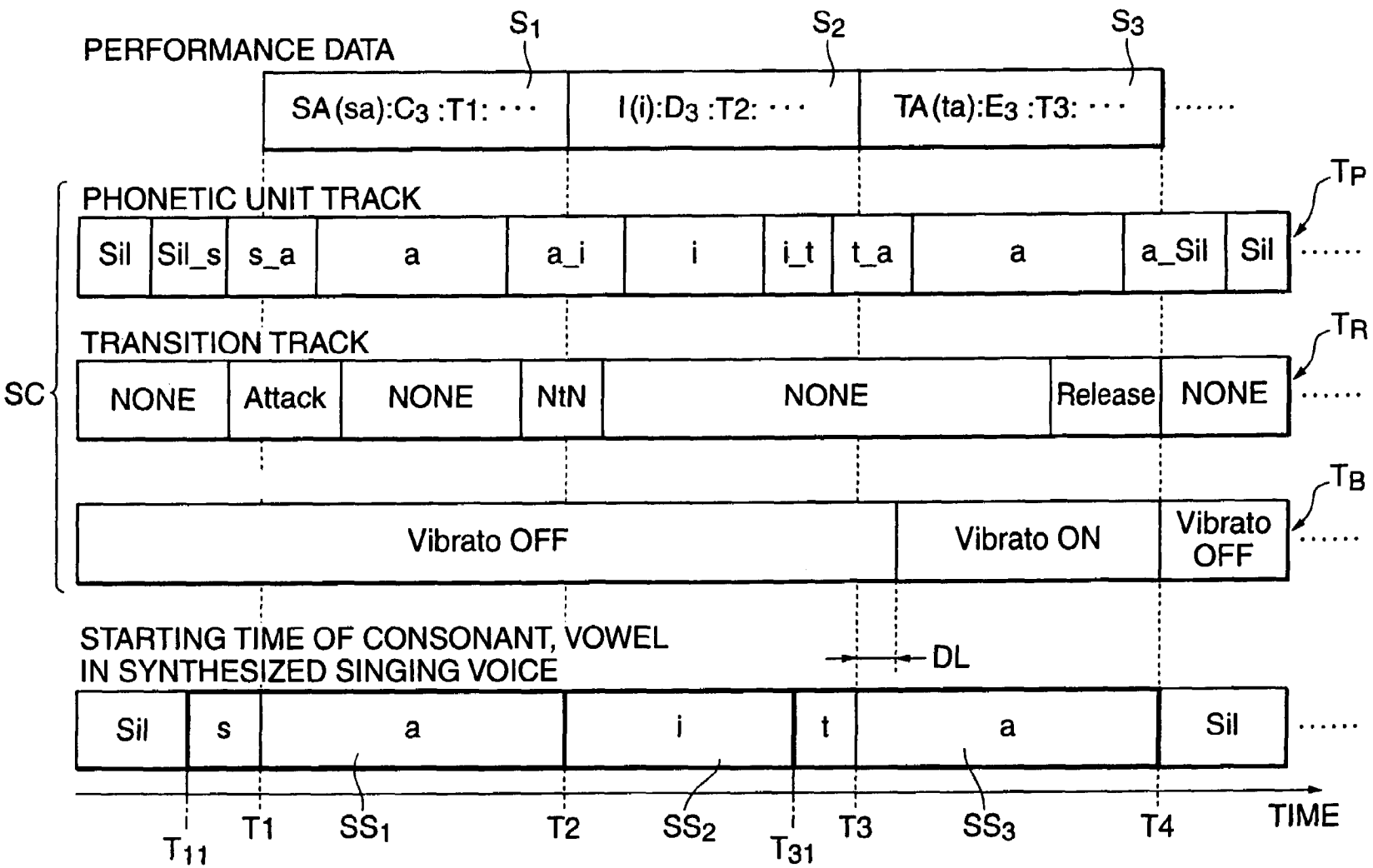
FIG. 13 is a diagram showing a manner of forming the singing voice synthesis score and a manner of synthesizing singing voices.

FIG. 13 shows an example of singing voice synthesis scores formed based on performance data in the step S42, and an example of singing voices synthesized in the step S44. The singing voice synthesis scores SC are formed within the RAM 16, and are each formed by a phonetic unit track $T_P$, a transition track $T_R$, and a vibrato track $T_B$. Data of singing voice synthesis scores SC are updated or added whenever performance data is received.

Assuming, for example, that performance data $S_1$, $S_2$, and $S_3$ designate, similarly to FIG. 1B, "sa: $C_3$: T1 . . . " "i: $D_3$: T2 . . . ", and "ta: $E_3$: T3 . . . ", respectively, information as shown in FIGS. 13 and 14 is stored in a phonetic unit track $T_P$. More specifically, items of information are arranged in the order of singing, i.e. silence (Sil), a transition (Sil_s) from the silence to a consonant "s", a transition (s_a) from the consonant "s" to a vowel "a", the vowel (a), etc. The information of silence Sil is comprised of items of information representative of a starting time point (Begin Time=T11), a duration time (Duration=D11), and a phonetic unit (PhU=Sil). The information of the transition Sil_s is comprised of items of information representative of a starting time point (Begin Time=T12), a duration time (Duration=D12), a preceding phonetic unit (PhU1=Sil) and the following phonetic unit (PhU2=s). The information of the transition s_a is comprised of items of information representative of a starting time point (Begin Time=T13), a duration time (Duration=D13), the preceding phonetic unit (PhU1=s) and the following phonetic unit (PhU2=a). The information of the vowel a is comprised of items of information representative of a starting time point (Begin Time=T14), a duration time (Duration=D14), and a phonetic unit (PhU=a).

The information of duration times of phonetic unit transitions, such as "Sil_a" and "s_a" is comprised of a combination of the time length of the preceding phonetic unit and the time length of the following phonetic unit, with the boundary between the time lengths being held as time slot information. Therefore, the time slot information can be used to instruct the tone generator circuit 28 to operate according to the duration time of the preceding phonetic unit and the starting time point and duration time of the following phonetic unit. For example, based on the duration time information of the transition Sil_s, the circuit 28 can be instructed to operate according to the duration time of silence and the singing-starting time point $T_{11}$ and singing duration time of the consonant "s", and based on the duration time information of the transition s_a, the circuit 28 can be instructed to operate according to the duration time of the consonant "a" and the singing-starting time point T1 and singing duration time of the vowel "a".

Information as shown in FIGS. 13 and 15 is stored in the transition track $T_R$. More specifically, items of state information are arranged in the order of occurrence of transition states, e.g. no transition state (denoted as NONE), an attack transition state (Attack), a note transition state (NtN), NONE, a release transition state (Release), NONE, etc. The state information in the transition track $T_R$ is formed based on the performance data and information in the phonetic unit track $T_P$. The state information of the attack transition state Attack corresponds to the information of the phonetic unit transition from "s" to "a" in the phonetic unit track $T_P$, the state information of the note transition state NtN to the information of the phonetic unit transition from "a" to "i", and the state information of the release transition state Release to the information of the phonetic unit transition from "a" to "Sil" in the phonetic unit track $T_P$. Each state information is used for adding minute changes in pitch and amplitude, to a singing voice synthesized based on the information of a corresponding phonetic unit transition. Further, in the example of FIG. 13, the state information of NtN corresponding to the phonetic unit transition from "t" to "a" is not provided.

As shown in FIG. 15, the state information of the first no transition state NONE is comprised of items of information representative of a starting time point (Begin Time=T21), a duration time (Duration=D21), and a transition index (Index=NONE). The state information of the attack transition state Attack is comprised of items of information representative of a starting time point (Begin Time=T22), a duration time (Duration=D22), a transition index (Index=Attack), and the type of the transition index (e.g. "normal", Type=Type22). The transition information of the second no transition state NONE is the same as that of the first no transition state NONE except that the starting time point and the duration time are T23 and D23, respectively. The state information of the note transition state NtN is comprised of items of information representative of a starting time point (Begin Time=T24), a duration time (Duration=D24), a transition index (Index=NtN), and the type of the transition index (e.g. "normal", Type=Type24). The state information of the third no transition state NONE is the same as that of the first no transition state NONE except that the starting time point and the duration time are T25 and D25, respectively. The state information of the release transition state Release is comprised of respective items of information representative of a starting time point (Begin Time=T26), a duration time (Duration=D26), a transition index (Index=Release), and the type of the transition index (e.g. "normal", Type=Type26).

Information as shown in FIGS. 13 and 16 is stored in the vibrato track $T_B$. More specifically, items of the information are arranged in the order of occurrence of vibrato events, e.g. vibrato off, vibrato on, vibrato off, and so forth. The information of a first vibrato off event is comprised of items of information representative of a starting time point (Begin Time=T31), a duration time (Duration=D31), and a transition index (Index=OFF). The information of a vibrato on event is comprised of items of information representative of a starting time point (Begin Time=T32), a duration time (Duration=D32), a transition index (Index=ON), and the type of the vibrato (e.g. "normal", Type=Type32). The information of a second vibrato off event is the same as that of the first one except that the starting time point and the duration time are T33 and D33, respectively.

The information of the vibrato on event corresponds to the information of the vowel "a" of the phonetic unit "ta" in the phonetic unit track $T_P$, and is used for adding vibrato-like changes in pitch and amplitude to a singing voice synthesized based on the information of the vowel "a". In the information of the vibrato on event, by setting the starting time point later than the starting time point T3 at which the singing voice "a" is to start being generated, by a delay time DL, a delayed vibrato can be realized. It should be noted that starting time points T11 to T14, T21 to T26, T31 to T33, etc., and duration times D11 to D14, D21 to D26, D31 to D33, etc. can be set as desired by using the number of clocks of the tempo clock signal TCL.

By using the singing voice synthesis score SC and the performance data S1 to S3, the singing voice-synthesizing process in the step S44 can synthesize the singing voice as shown in FIG. 13. After realizing silence time before starting the singing based on the information of silence Sil in the phonetic unit track $T_P$, the tone generator control information corresponding to the information of the transition Sil_s in the track $T_P$ and the pitch information of $C_3$ in the performance data $S_1$ is read out from the phonetic unit transition DB 14*b* shown in FIG. 6B to control the tone generator circuit 28, whereby the consonant "s" starts to be generated at the time point $T_{11}$. The control time period at this time corresponds to the duration time designated by the information of the transition Sil_s in the track $T_P$. Then, the tone generator control information corresponding to the information of the transition s_a in the track $T_P$ and the pitch information of $C_3$ in the performance data $S_1$ is read out from the DB 14*b* to control the tone generator circuit 28, whereby the vowel "a" starts to be generated at the time point T1. The control time period at this time corresponds to the duration time designated by the information of the transition s_a in the track $T_P$. As a result, the phonetic unit "sa" is generated as the singing voice $SS_1$.

Following this, the tone generator control information corresponding to the information of the vowel "a" in the track $T_P$ and the pitch information of $C_3$ in the performance data $S_1$ is read out from the phonetic unit DB 14*a* to control the tone generator circuit 28, whereby the vowel "a" continues to be generated. The control time period at this time corresponds to the duration time designated by the information of the vowel "a" in the track $T_P$. Then, the tone generator control information corresponding to the information of the transition a_i in the track $T_P$ and the pitch information of $D_3$ in the performance data $S_2$ is read out from the DB 14*b* to control the tone generator circuit 28, whereby the generation of the vowel "a" is stopped and at the same time the generation of the vowel "i" is started at the time point T2. The control time period at this time corresponds to the duration time designated by the information of the transition "a_i" in the track $T_P$.

Following this, similarly to the above, the tone generator control information corresponding to the information of the vowel "i" and the pitch information of $D_3$ and one corresponding to the information of a transition i_t in the track $T_P$ and the pitch information of $D_3$ are sequentially read out to control the tone generator circuit 28, whereby the generation of the vowel "i" is continued until the time point $T_{31}$, and at this time point $T_{31}$, the generation of the consonant "t" is started. Then, after starting the generation of the vowel "a" at the time point T3, based on the tone generator control information corresponding to the information of the transition t_a and the pitch information of $E_3$, the tone generator control information corresponding to the information of the vowel a in the track $T_P$ and the pitch information of $E_3$ and one corresponding to the information of the transition a_Sil in the track $T_P$ and the pitch information of $E_3$ are sequentially read out to control the tone generator circuit 28, whereby the generation of the vowel "a" is continued until the time point T4, and at this time point T4, the state of silence is started. As a result, as the singing voices $SS_2$, $SS_3$, the phonetic units "i" and "ta" are sequentially generated.

In accordance with the generation of the singing voices as described above, the singing voice control is carried out based on the information in the performance data $S_1$ to $S_3$ and the information in the transition track $T_R$. More specifically, before and after the time point T1, the tone generator control information corresponding to the state information of the transition state Attack in the track $T_R$ and the information of the transition s_a in the track $T_P$ are read out from the state transition DB 14*c* in FIG. 7 to control the tone generator circuit 28, whereby minute changes in pitch, amplitude, and the like are added to the singing voice "s_a". The control time period at this time corresponds to the duration time designated by the state information of the attack transition state Attack. Further, before and after the time point T2, the tone generator control information corresponding to the state information of the note transition state NtN in the track $T_R$ and the information of the transition a_i in the track $T_P$, and the pitch information $D_3$ in the performance data $S_2$ is read out from the DB 14*c* to control the tone generator circuit 28, whereby minute changes in pitch, amplitude, and the like are added to the singing voice "a_i". The control time period at this time corresponds to the duration time designated by the state information of the note transition state NtN. Further, immediately before the time point T4, the tone generator control information corresponding to the state information of the release transition state Release in the track $T_R$ and the information of the vowel a in the track $T_P$, and the pitch information $E_3$ in the performance data $S_3$ is read out from the DB 14*c* to control the tone generator circuit 28, whereby minute changes in pitch, amplitude, and the like are added to the singing voice "a". The control time period at this time corresponds to the duration time designated by the state information of the release transition state Release. According to the singing voice control described above, it is possible to synthesize natural singing voices with the feelings of attack, note transition, and release.

Further, in accordance with generation of the singing voices described above, the singing voice control is carried out based on the information of the performance data $S_1$ to $S_3$, and the information in the vibrato track $T_B$. More specifically, at a time later than the time point T3 by the delay time DL, the tone generator control information corresponding to the information of a vibrato on event in the track $T_B$, the information of the vowel a in the track $T_P$, and the pitch information of $E_3$ in the performance data $S_3$ is read out from the vibrato DB 14*d* shown in FIG. 8 to control the tone generator circuit 28, whereby vibrato-like changes in pitch, amplitude and the like are added to the singing voice "a", and such addition is continued until the time point T4. The control time period at this time corresponds to the duration time designated by the information of the vibrato on event in the track $T_B$. Further, the depth and speed of vibrato are determined by the information of the vibrato type in the performance data $S_3$. According to the singing voice control described above, it is possible to synthesize natural singing voices by adding vibrato to desired portions of the singing.

Figure 17:
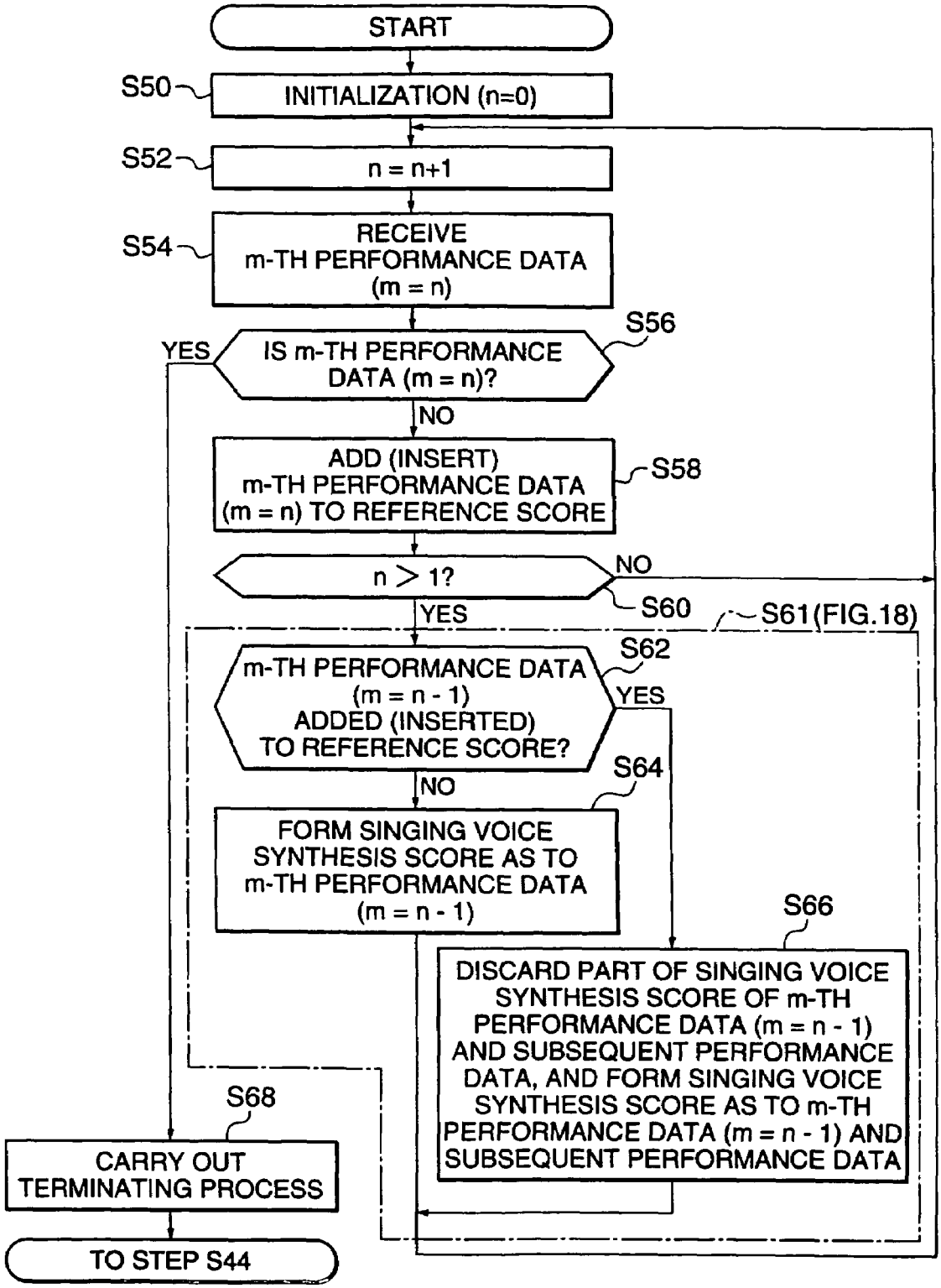
FIG. 17 is a flowchart showing a performance data-receiving process/singing voice synthesis score-forming process.

Next, the performance data-receiving and singing voice synthesis score-forming process will be described with reference to FIG. 17.

In a step S50, the initialization of the system is carried out, whereby, for example, the count n of a reception counter in the RAM 16 is set to 0.

In a step S52, the count n of the reception counter is incremented by 1 (n=n+1). Then, in a step S54, a variable m is set to the value or count n of the counter, and performance data at an m-th (m=n) position in the sequence of performance data (hereinafter simply refereed to as the "m-th performance data") is received and written into the receiving buffer in the RAM 16.

In a step S56, it is determined whether or not the m-th (m=n) performance data is at the end of the data, i.e. the last data. If first (m=1) data is received in the step S54, the answer to the question of the step S56 becomes negative (N), and hence the process proceeds to a step S58. In the step S58, m-th (m=n) performance data is read out from the receiving buffer and written into the reference score in the RAM 16. It should be noted that once the first (m=1) performance data has been written into the reference score, subsequent performance data are either added to or inserted into the reference score, as described hereinabove with reference to FIGS. 10 to 12.

Then, in a step S60, it is determined whether or not n>1 holds. If the first (m=1) performance data has been received, the answer to the question of the step S60 becomes negative (N), so that the process returns to the step S52, wherein the count n is incremented to 2, and in the following step S54, second (m=2) performance data is received and written into the receiving buffer. Then, the process proceeds via the step 56 to the step S58, wherein the second (m=2) performance data is added to the reference score.

Then, it is determined in the step S60 whether or not n>1 holds, and in the present case, since the count n is equal to 2, the answer to this question becomes affirmative (Y), so that the singing voice synthesis score-forming process is carried out in a step S61. Although the process in the step S61 will be described in detail with reference to FIG. 18, the outline thereof can be described as follows: It is determined in a step S62 whether or not m-th (m=n−1) performance data has been inserted into the reference score. For example, since the m-th (m=1) performance data has not been inserted but simply written into the reference score, the answer to the question of the step S62 becomes negative (N), so that the process proceeds to a step S64, wherein a singing voice synthesis score is formed concerning the m-th (m=n−1) performance data. For example, when the second (m=2) performance data is received in the step S54, a singing voice synthesis score is formed concerning the first (m=1) performance data in the step S64.

After the processing in the step S64 is completed, the process returns to the step S52, wherein similarly to the above, the reception of performance data and writing of the received performance data into the reference score are carried out. For example, after forming the singing voice synthesis score is formed concerning the first (m=1) performance data in the step S64, third (m=3) performance data is received in the step S54, and in the step S58, this data is added to or inserted into the reference score.

If the answer to the question of the step S62 is affirmative (Y), this means that m-th (m=n−1) performance data has been inserted into the reference score, so that the process proceeds to a step S66, wherein singing voice synthesis scores whose actual singing-starting time points are later than that of the m-th (m=n−1) performance data are discarded, and singing voice synthesis scores are newly formed concerning the m-th (m=n−1) data and performance data subsequent thereto in the reference score. For example, assuming that after receiving performance data $S_1$, $S_3$, $S_4$, as shown in FIGS. 11 and 12, performance data $S_2$ is received, the m-th (m=4) performance data $S_2$ is added to the reference score in the step S58. Then, the process proceeds via the step S60 to the step S62, and since the third (m=4−1=3) performance data $S_4$ has been added to the reference score, the answer to the question of the step S62 becomes negative (N), so that the process returns via the step S64 to the step 52. Then, after receiving fifth (m=5) performance data in the step S54, the process proceeds via the steps S56, S58, S60 to the step S62, wherein since the fourth (m=4) performance data S4 has been inserted into the reference score, the answer to the question of this step becomes affirmative Y), so that the process proceeds to the step S66, wherein singing voice synthesis scores ($SC_{3a}$ etc. in FIG. 12) whose actual singing-starting time points are later than that of the fourth (m=4) performance data are discarded, and singing voice synthesis scores are newly formed concerning the fourth (m=4) performance data and subsequent performance data in the reference score ($S_2$, $S_3$, $S_4$ in FIG. 12).

After the processing in the step S66 is completed, the process returns to the step S52, the processing similar to the above is repeatedly carried out. When the m-th (m=n) performance data is at the end of the data, the answer to the question of the step S56 becomes affirmative (Y), and in a step S68, a terminating process (e.g. addition of end information) is carried out. The execution of the step S68 is followed by the singing voice-synthesizing process being carried out in the step S44 in FIG. 3.

Figure 18:
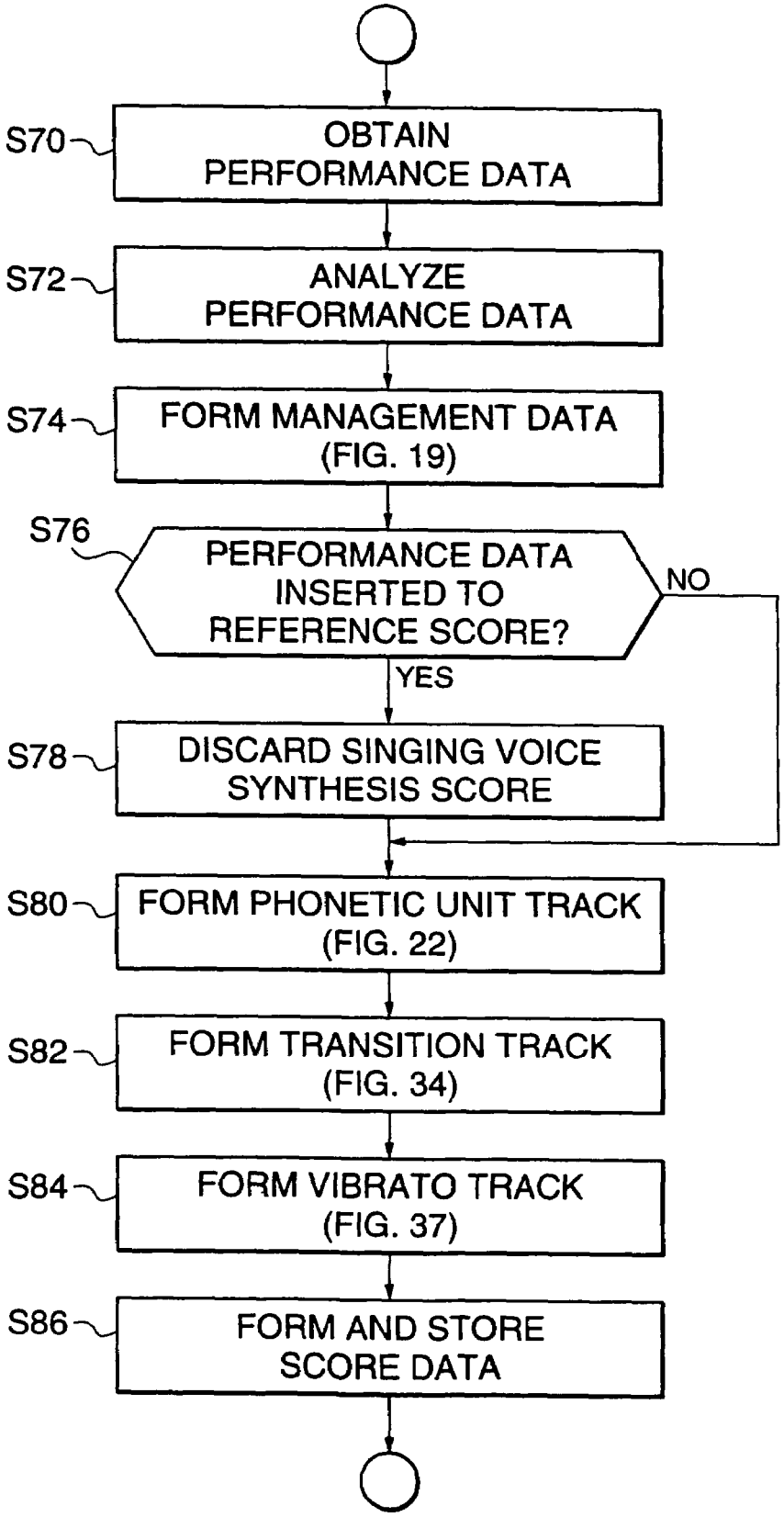
FIG. 18 is a flowchart showing the details of the singing voice synthesis score-forming process.

FIG. 18 shows the singing voice synthesis score-forming process. First, in a step S70, performance data containing performance information shown in FIG. 4 is obtained from the reference score. In a step S72, the performance information contained in the obtained performance data is analyzed. In a step S74, based on the analyzed performance information and the stored management data (management data of preceding performance data), management data for forming the singing voice synthesis score is prepared. The processing in the step S74 will be described in detail hereinafter with reference to FIG. 19.

Then, in a step S76, it is determined whether or not the obtained performance data has been inserted into the reference score when it has been written into the reference score. If the answer to this question is affirmative (Y), in a step S78, singing voice synthesis scores whose actual singing-starting time points are later than that of the obtained performance data are discarded.

When the processing in the step S78 is completed or if the answer to the question of the step S76 is negative (N), the process proceeds to a step S80, wherein a phonetic unit track-forming process is carried out. This process in the step S80 forms a phonetic unit track $T_P$ based on performance data, the management data formed in the step S74, and the stored score data (score data of the preceding performance data). The details of the process will be described hereinafter with reference to FIG. 22.

In a step S82, a transition track $T_R$ is formed based on the performance information, the management data formed in the step S74, the stored score data, and the phonetic unit track $T_P$. The details of the process in the step S82 will be described hereinafter with reference to FIG. 34.

In a step S84, a vibrato track $T_B$ is formed based on the performance information, the management data formed in the step S74, the stored score data, and the phonetic unit track $T_P$. The details of the process in the step S84 will be described hereinafter with reference to FIG. 37.

In a step S86, score data for the next performance data is formed based on the performance information, the management data formed in the step S74, the phonetic unit track $T_P$, the transition track $T_R$, and the vibrato track $T_B$, and stored. The score data contains an NtN transition time length from the preceding vowel. As shown in FIG. 36, the NtN transition time length consists of a combination of a time length $T_1$ of the preceding note (preceding vowel) and a time length $T_2$ of the following note (present performance data), with the boundary between the two time lengths being held as time slot information. To calculate the NtN transition time length, the state transition time length of the note transition state NtN corresponding to phonetic units, pitch, and a note transition type (e.g. "normal") in the performance information is read from the state transition DB 14*c* shown in FIG. 7, and this state transition time length is multiplied by the singing note transition expansion/compression ratio in the performance data. The NtN transition time length obtained as the result of multiplication is used as the duration time information in the state information of note transition state NtN, shown in FIGS. 13 and 15.

Figure 19:
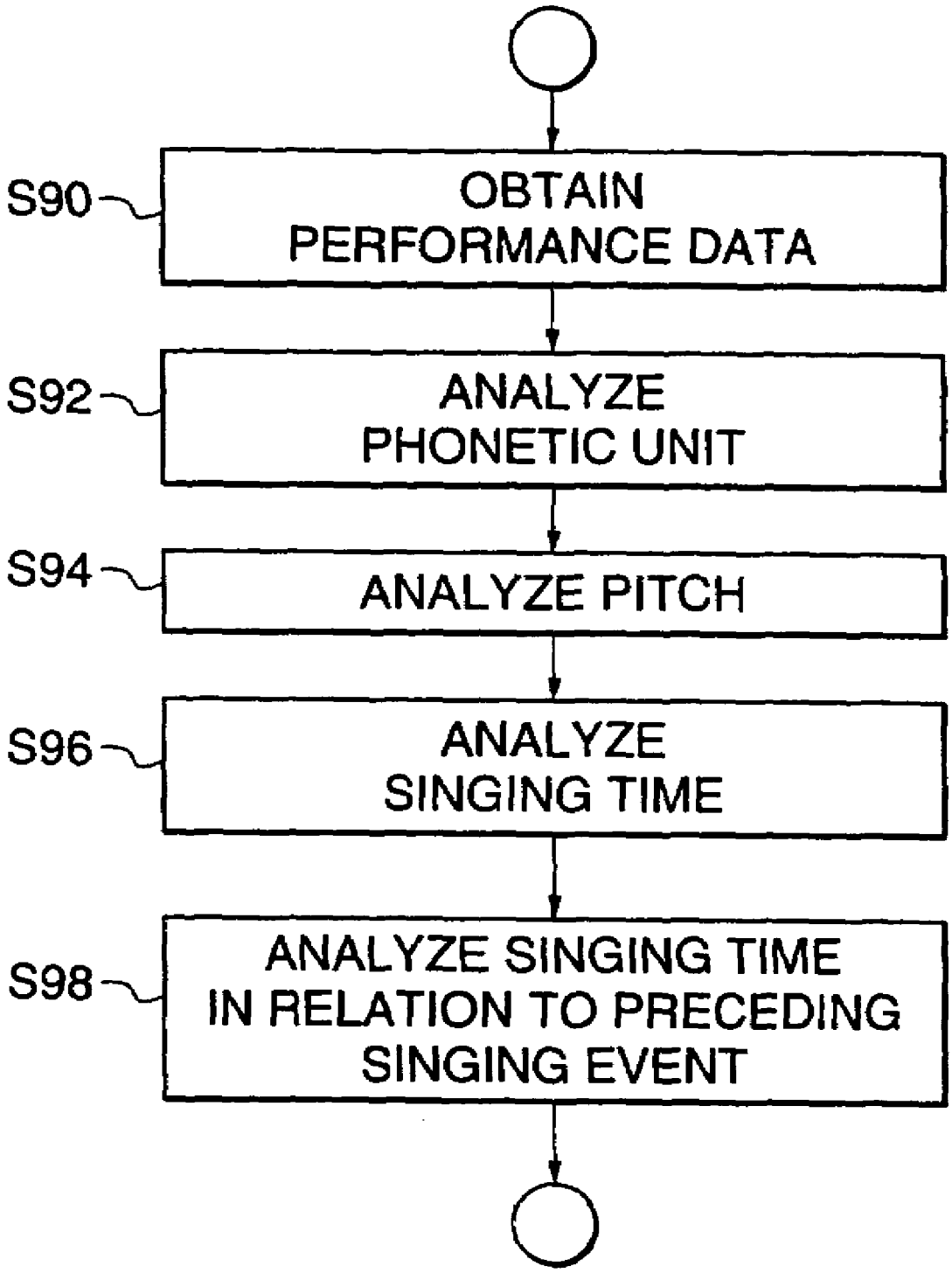
FIG. 19 is a flowchart showing a management data-forming process.
Figure 20:
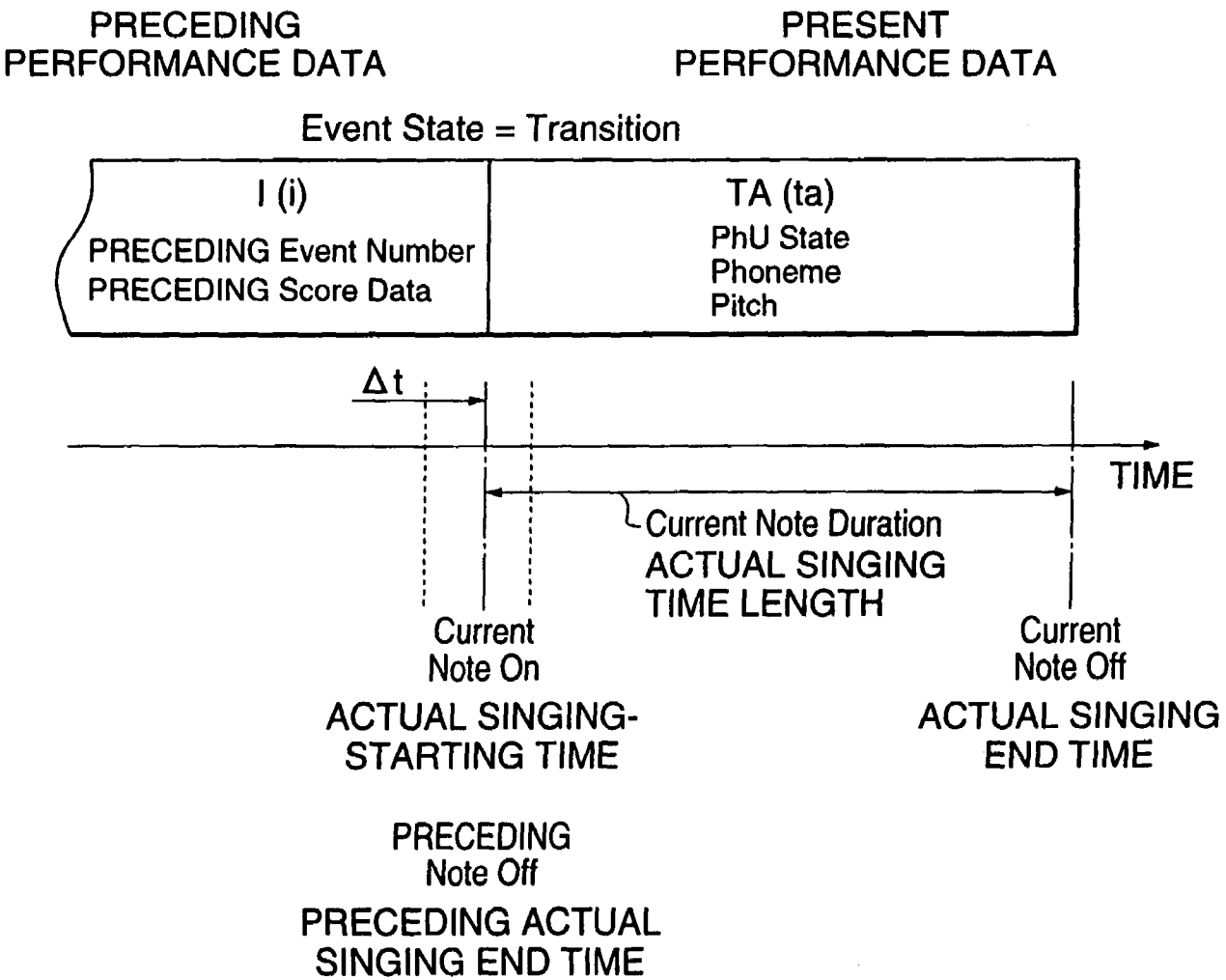
FIG. 20 is a diagram useful in explaining a management data-forming process in the case of Event State=Transition.
Figure 21:
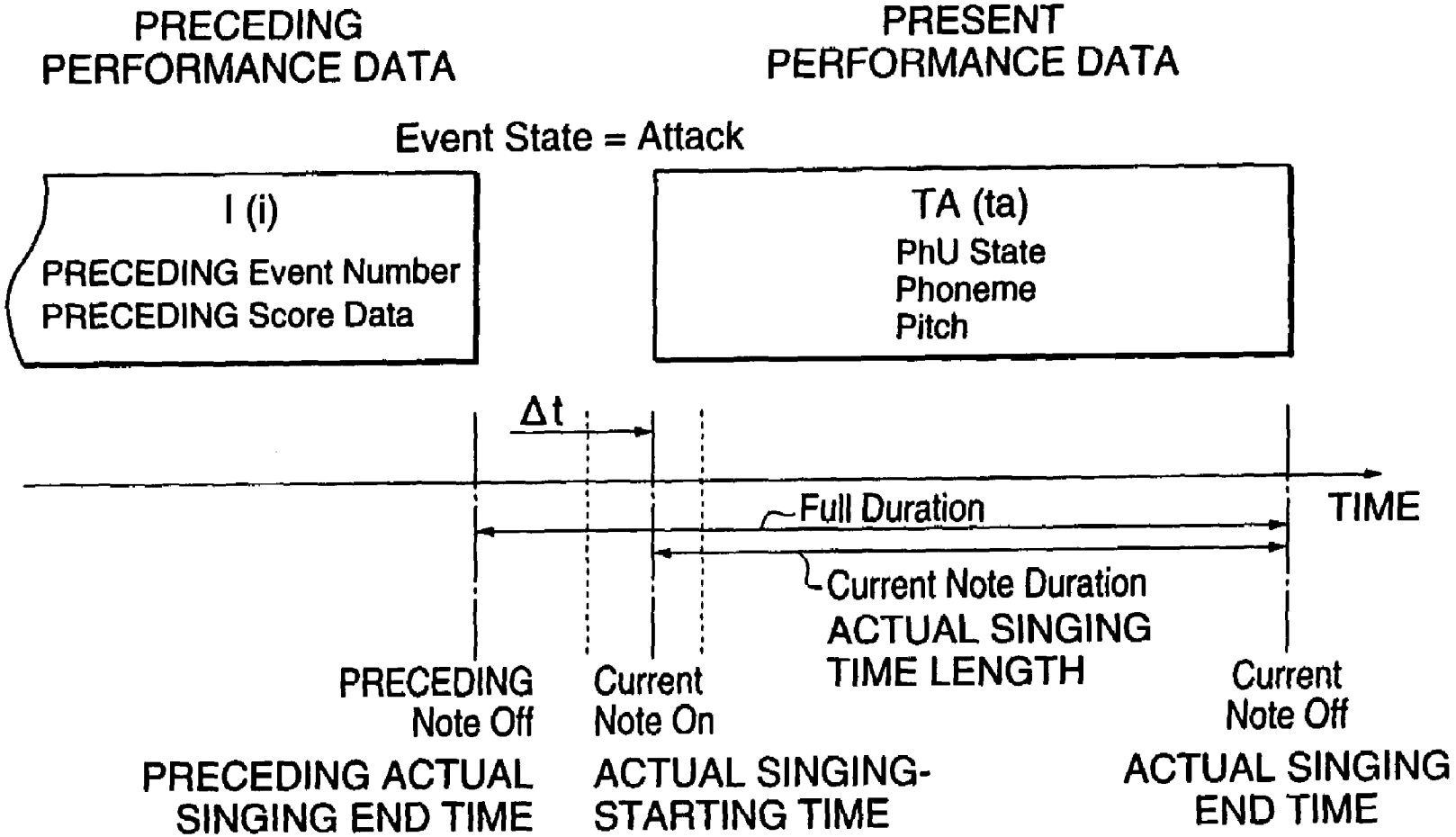
FIG. 21 is a diagram useful in explaining a management data-forming process in the case of Event State=Attack.

FIG. 19 shows the management data-forming process. The management data includes, as shown in FIGS. 20 and 21, items of information of a phonetic unit state (PhU state), a phoneme, pitch, current note on, current note duration, current note off, full duration, and an event state.

When the performance data is obtained in a step S90, at the following step S92, the singing phonetic unit in the performance data is analyzed. The information of a phonetic unit state represents a combination of a consonant and a vowel, a vowel alone, or a voiced consonant alone. In the following, for convenience, the combination of a consonant and a vowel will be referred to as PhU State=Consonant Vowel, and the vowel alone or the voiced consonant alone as PhU State=Vowel. The information of a phoneme represents the name of a phoneme (name of a consonant and/or name of a vowel), the category of the consonant (nasal sound, plosive sound, half vowel, etc.), whether the consonant is voiced or unvoiced, and so forth.

In a step S94, the pitch of a singing voice in the performance data is analyzed, and the analyzed pitch of the singing voice is set as the pitch information "Pitch". In a step S96, the actual singing time in the performance data is analyzed, and the actual singing-starting time point of the analyzed actual singing time is set as the current note-on information "Current Note On". Further, the actual singing length is set as the current note duration information "Current Note Duration", and a time point later than the actual singing-starting time point by the actual singing length is set as the current note-off information "Current Note Off".

As the current note-on information, the time point obtained by modifying the actual singing-starting time point may be employed. For example, a time point ($t_0 \pm \Delta t$, where $t_0$ indicates the actual singing-starting time point) obtained by randomly changing the actual singing-starting time point through a random number-generating process or the like, by $\Delta t$ within a predetermined time range (indicated by two broken lines in FIGS. 20 and 21) before and after the actual singing-starting time point (indicated by a solid line in FIGS. 20 and 21) may be set as the current note-on information.

In a step S98, by using the management data of preceding performance data, the singing time points of the present performance data are analyzed. In the management data of the preceding performance data, the information "Preceding Event Number" represents the number of preceding performance data received, of which the rearrangement has been completed. The data "Preceding Score Data" is score data formed and stored in the step S86 when a singing voice synthesis score was formed concerning the preceding performance data. The information "Preceding Note Off" represents a time point at which the preceding actual singing should be terminated. The information "Event State" represents a state of connection (whether silence is interposed) between a preceding singing event and a current singing event determined based on the information "Preceding Note Off" and the current note-on information. In the following, for convenience, a state in which the current singing event is continuous from the preceding singing event (i.e. without silence), as shown in FIG. 20, will be indicated by Event State=Transition, and a state in which silence is interposed between the preceding singing event and the current singing event, as shown in FIG. 21, will be indicated by Event State=Attack. The information "Full Duration" represents a time length between a time point designated by the information "Preceding Note Off" at which the preceding actual singing should be terminated and a time designated by the current note-off information "Current Note Off" at which the current actual singing should be terminated.

Figure 22:
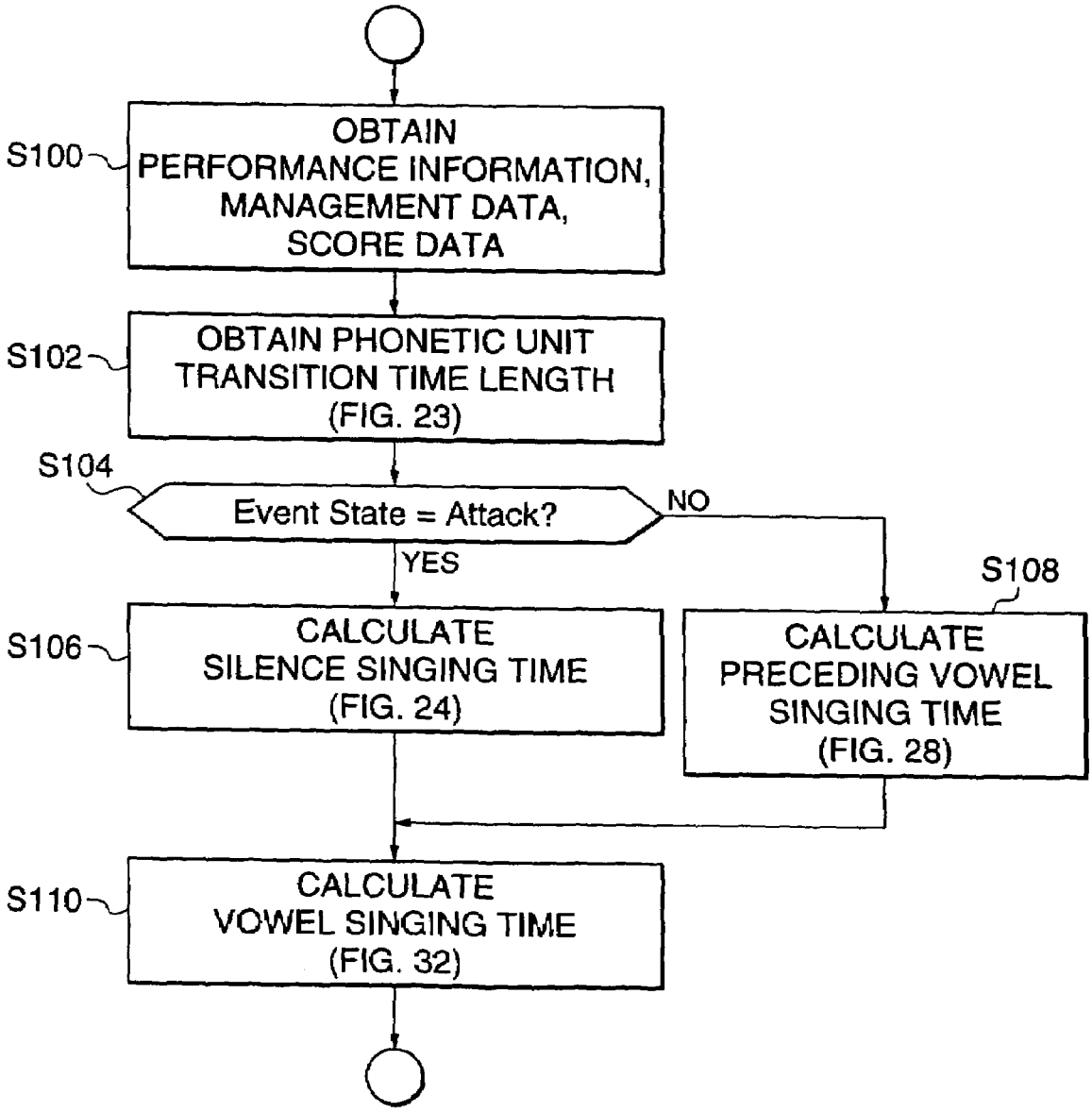
FIG. 22 is a flowchart showing a phonetic unit track-forming process.

Next, the phonetic unit track-forming process will be described with reference to FIG. 22. In a step S100, performance information (contents of performance data), the management data and the score data are obtained. In a step S102, a phonetic unit transition time length is obtained (read out) from the phonetic unit transition DB 14*b* shown in FIG. 6B based on the obtained data. The details of the processing in the step S102 will be described hereinafter with reference to FIG. 23.

In a step S104, based on the management data, it is determined whether or not Event State=Attack holds. If the answer to this question is affirmative (Y), it means that preceding silence exists, and in a step S106, a silence singing length is calculated. The details of the processing in the step S106 will be described hereinafter with reference to FIG. 24.

If the answer to the determination in the step S104 is negative (N), it means that Event State=Transition holds, and hence a preceding vowel exists, so that in a step S108, a preceding vowel singing length is calculated. The details of the process in the step S108 will be described hereinafter with reference to FIG. 28.

When the processing in the step S106 or S108 is completed, in a step S110, a vowel singing length is calculated. The details of the processing in the step S110 will be described hereinafter with reference to FIG. 32.

Figure 23:
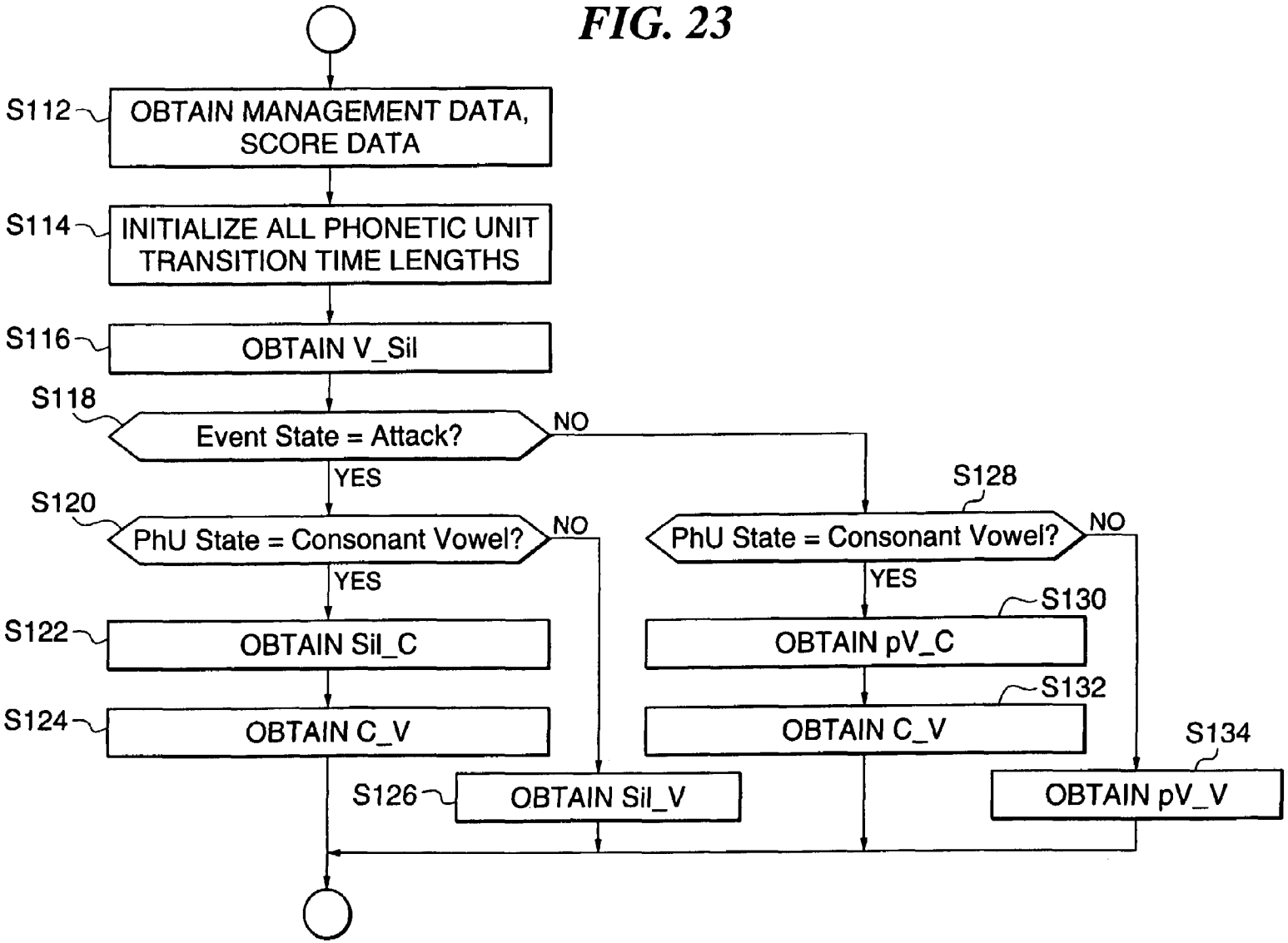
FIG. 23 is a flowchart showing a phonetic unit transition length-retrieving process.

FIG. 23 shows the phonetic unit transition time length-acquisition process carried out in the step S102.

In a step S112, management data and score data are obtained. Then, in a step S114, all phonetic unit transition time lengths (phonetic unit transition time lengths obtained in steps S116, S122, S124, S126, S130, S132, S134, all hereinafter referred to) are initialized.

In a step S116, a phonetic unit transition time length of V_Sil (vowel to silence) is retrieved from the DB 14*b* based on the management data. Assuming, for example, that the vowel is "a", and the pitch of the vowel is "P1", the phonetic unit transition time length corresponding to "a_Sil" and "P1" is retrieved from the DB 14*b*. The processing in the step S116 is related to the fact that in the Japanese language syllables terminate in vowel.

In a step S118, based on the management data, it is determined whether or not Event State=Attack holds. If the answer to this question is affirmative (Y), it is determined based on the management data in a step S120 whether or not PhU State=Consonant Vowel holds. If the answer to this question is affirmative (Y), a phonetic unit transition time length of Sil_C (silence to consonant) is retrieved from the DB 14*b* based on the management data in a step S122. Thereafter, in a step S124, based on the management data, a phonetic unit transition time length of C_V (consonant to vowel) is retrieved from the DB 14*b*.

If the answer to the question of the step S120 is negative (N), it means that PhU State=Vowel holds, so that in a step S126, a phonetic unit transition time length of Sil_V is retrieved from the DB 14*b* based on the management data. It should be noted that the details of the manner of retrieving the transition time lengths at the respective steps S122 to S126 are the same as described as to the step S116.

If the answer to the question of the step S118 is negative (N), similarly to the step S120, it is determined in a step S128 whether or not PhU state=Consonant Vowel holds. If the answer to this question is affirmative (Y), in a step S130, based on the management data and the score data, a phonetic unit transition time length of pV_C (preceding vowel to consonant) is retrieved from the DB 14*b*. Assuming, for example, that the score data indicates that the preceding vowel is "a", and the management data indicates that the consonant is "s" and its pitch is "P2", a phonetic unit transition time length corresponding to "a_s" and "P2" is retrieved from the DB 14*b*. Thereafter, in a step S132, similarly to the step S116, a phonetic unit transition time length of C_V (consonant to vowel) is retrieved from the DB 14*b* based on the management data.

If the answer to the question of the step S128 is negative (N), the process proceeds to a step S134, wherein similarly to the step S130, a phonetic unit transition time length of pV_V (preceding vowel to vowel) is retrieved from the DB 14*b* based on the management data and the score data.

Figure 24:
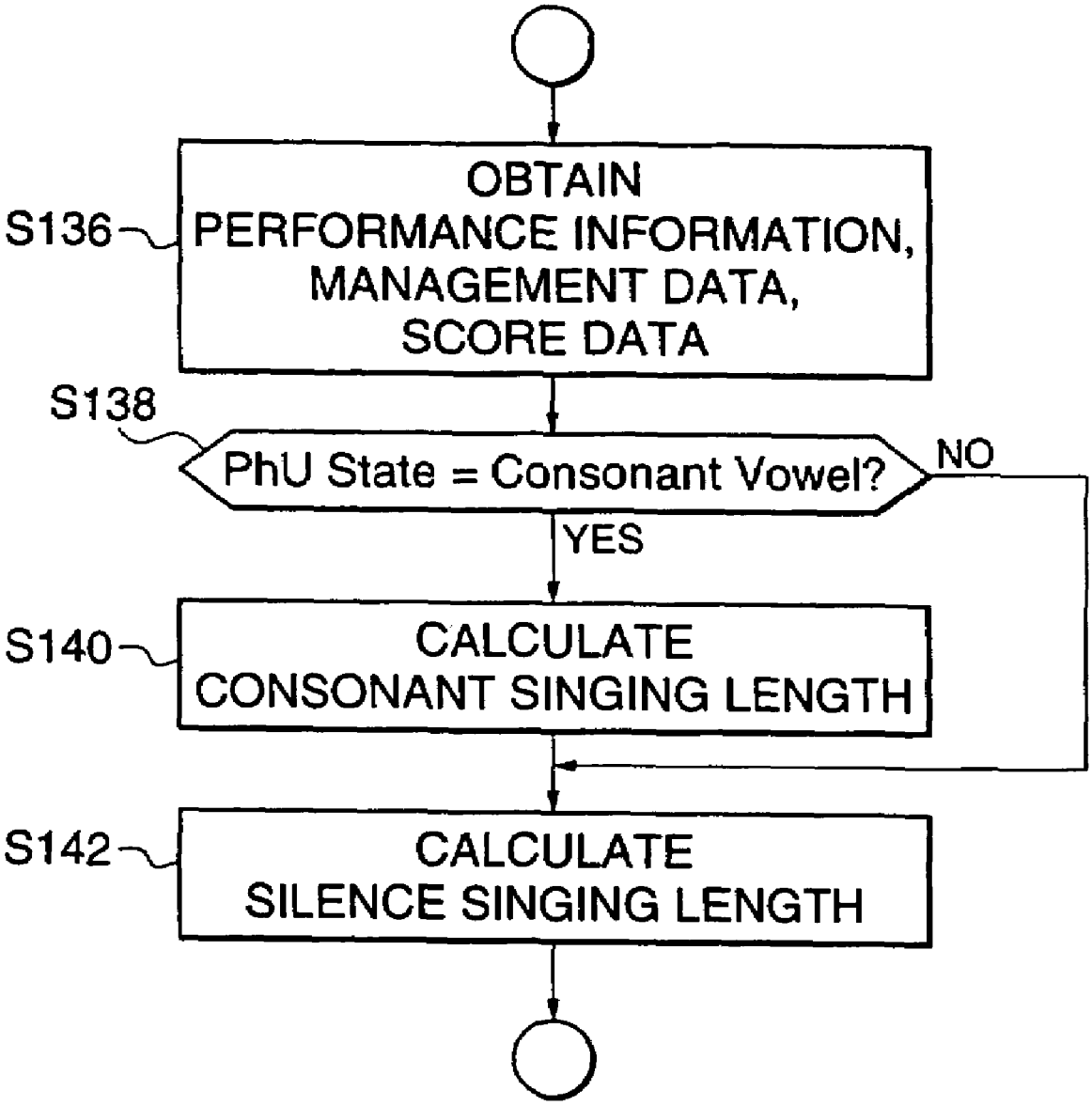
FIG. 24 is a flowchart showing a silence singing length-calculating process.

FIG. 24 shows the silence singing length-calculating process carried out in the step S106.

Figure 25:
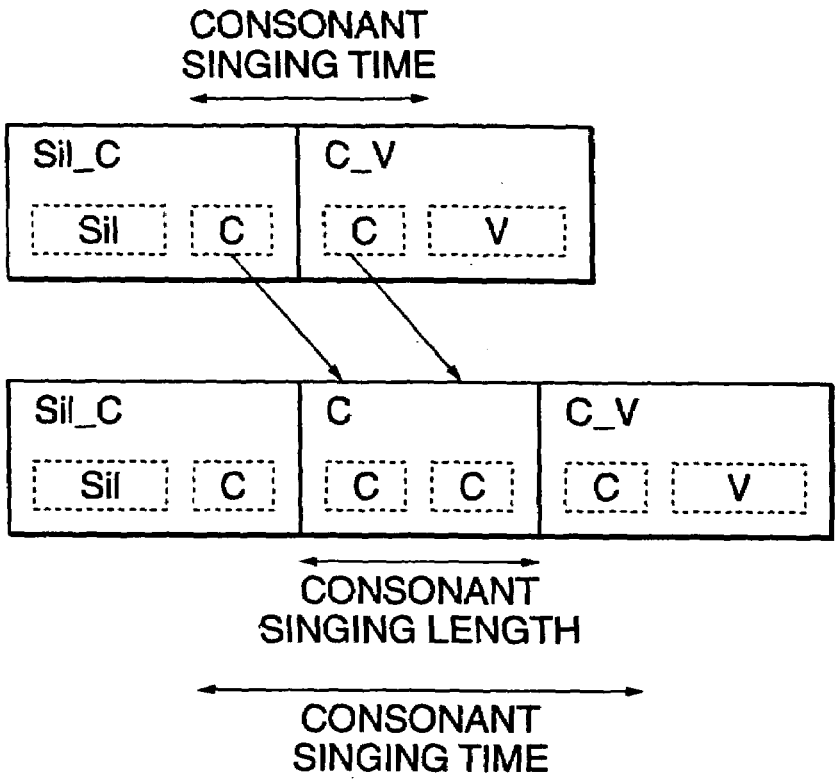
FIG. 25 is a diagram showing a consonant singing length-calculating process in the case of a consonant expansion/compression ratio being larger than 1, in the FIG. 24 process.

First, in a step S136, performance data, management data and score data are obtained. In a step S138, it is determined whether or not PhU State=Consonant Vowel holds. If the answer to this question is affirmative (Y), in a step S140, a consonant singing length is calculated. In this case, as shown in FIG. 25, the consonant singing time is determined by adding together a consonant portion of the silence-to-consonant phonetic unit transition time length, the consonant singing length, and a consonant portion of the consonant-to-vowel phonetic unit transition time length. Accordingly, the consonant singing length is part of the consonant singing time.

FIG. 25 shows an example of determination of the consonant singing length carried out when the singing consonant expansion/compression ratio contained in the performance information is larger than 1. In this case, the sum of the consonant length of Sil_C and the consonant length of C_V added together is used as a basic unit, and this basic unit is multiplied by the singing consonant expansion/compression ratio to obtain the consonant singing length C. Then, the consonant singing time is lengthened by interposing the consonant singing length C between Sil_C and C_V.

Figure 26:
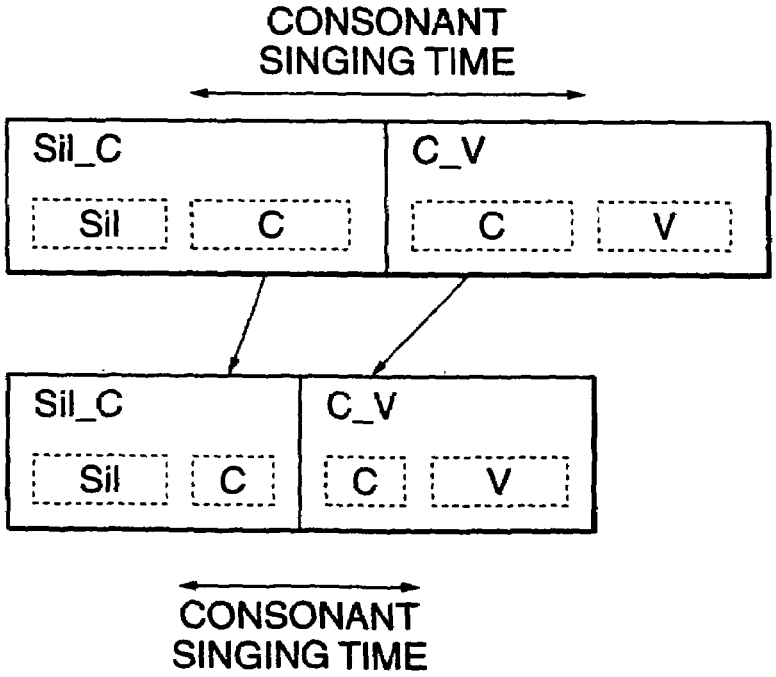
FIG. 26 is a diagram showing a consonant singing length-calculating process in the case of the consonant expansion/compression ratio being smaller than 1, in the FIG. 24 process.

FIG. 26 shows an example of determination of the consonant singing length carried out when the singing consonant expansion/compression ratio contained in the performance information is smaller than 1. In this case, the consonant length of Sil_C and the consonant length of C_V are each multiplied by the singing consonant expansion/compression ratio to shorten the respective consonant lengths. As a result, the consonant singing time formed by the consonant length of Sil_C and the consonant length of C_V is shortened.

In a step S142, the silence singing length is calculated. As shown in FIG. 27, silence time is determined by adding together a silence portion of a preceding vowel-to-silence phonetic unit transition time length, a silence singing length, a silence portion of a silence-to-consonant phonetic unit transition time length, and a consonant singing time, or adding together a silence portion of a preceding vowel-to-silence phonetic unit transition time length, a silence singing length, a silence portion of a silence-to-vowel phonetic unit transition time length. Therefore, the silence singing length is part of the silence time. In the step S142, in accordance with the order of singing, the silence singing length is calculated such that the boundary between the consonant portion of C_V and the vowel portion of the same, or the boundary between the silence portion of Sil_V and the vowel portion of the same coincides with the actual singing-starting time point (Current Note On). In short, the silence singing length is calculated such that the singing-starting time point of the vowel of the present performance data coincides with the actual singing-starting time point.

Figure 27A:
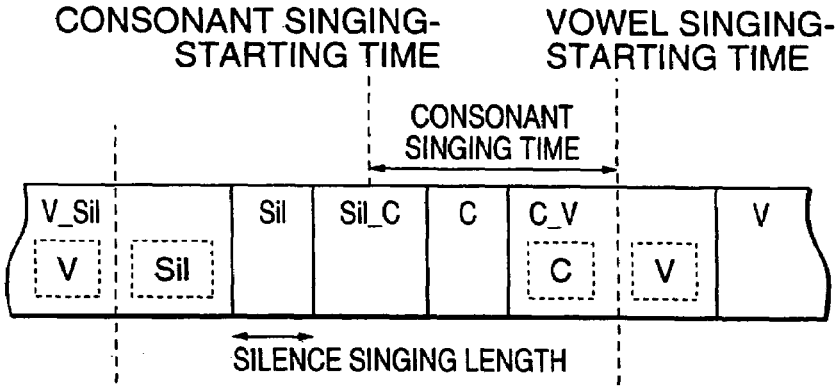
FIGS. 27A to 27C are diagrams showing examples of silence singing length calculation.
Figure 27B:
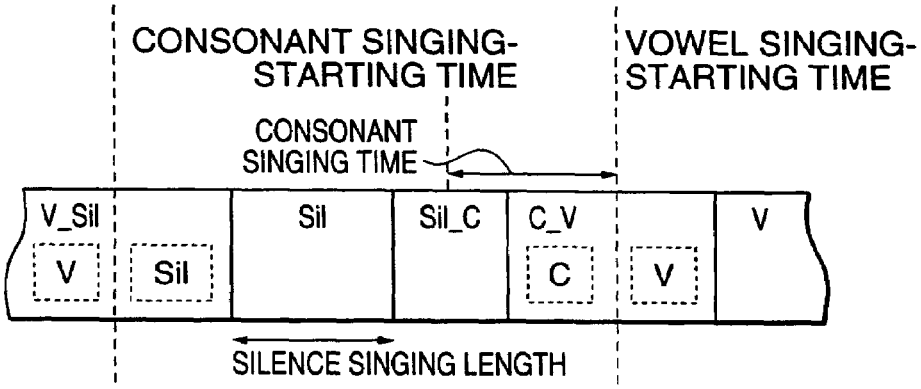
Figure 27C:
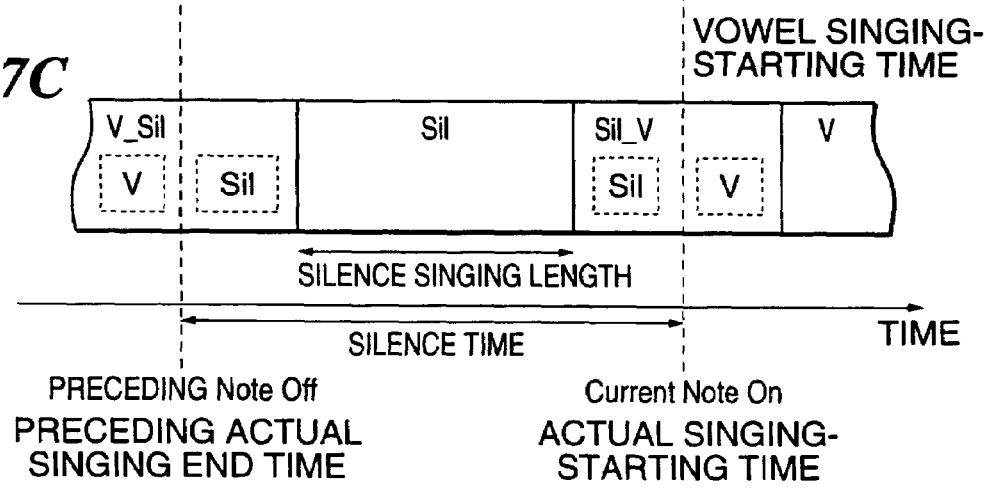

FIGS. 27A to 27C show phonetic unit connection patterns different from each other. The pattern shown in FIG. 27A corresponds to a case of a preceding vowel "a"-silence-"sa", for example, in which to lengthen the consonant "s", the consonant singing length C is inserted. The pattern shown in FIG. 27B corresponds to a case of a preceding vowel "a"-silence-"pa", for example. The pattern shown in FIG. 27C corresponds to a case of a preceding vowel "a"-silence-"i", for example.

Figure 28:
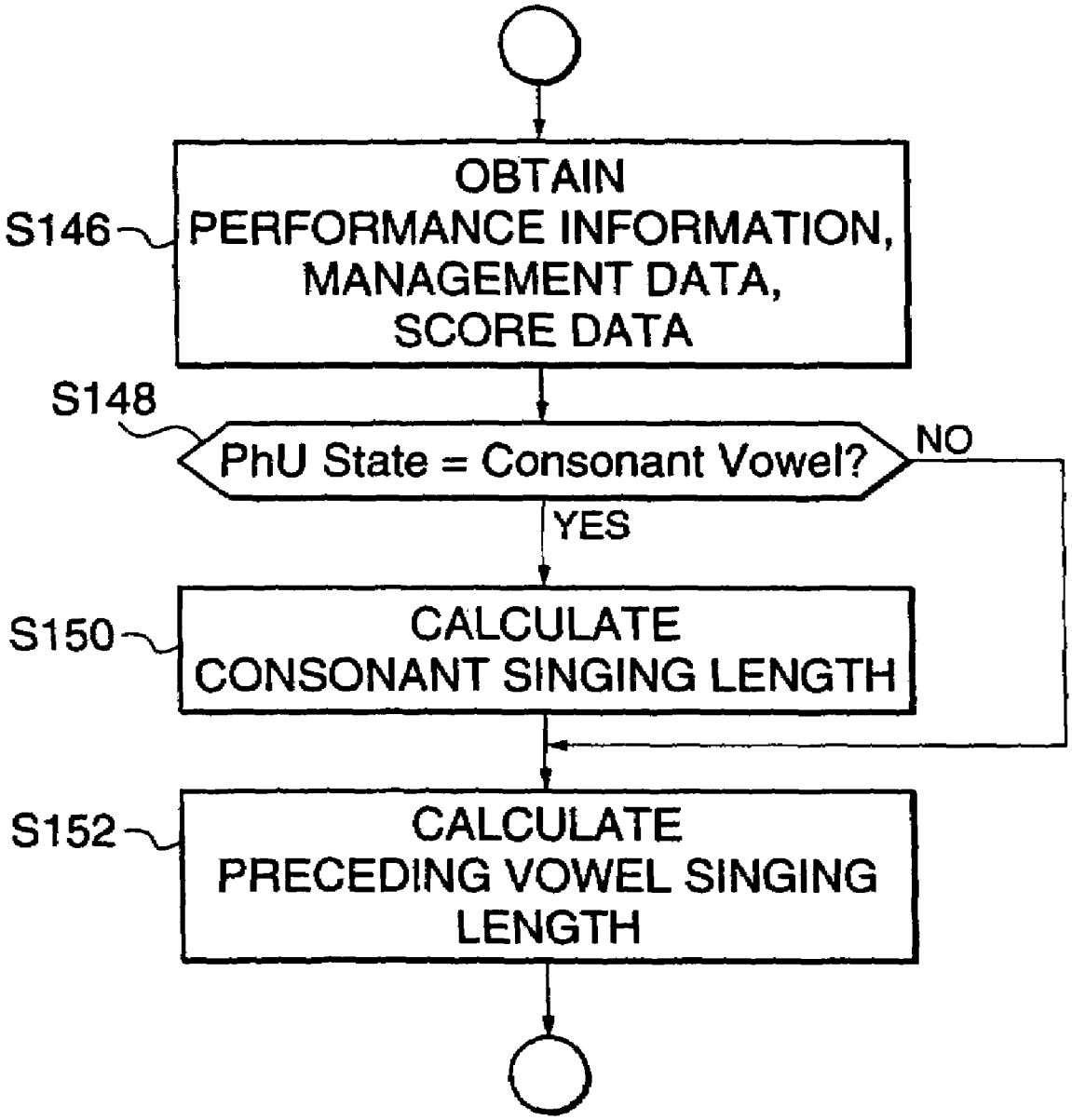
FIG. 28 is a flowchart showing a preceding vowel singing length-calculating process.

FIG. 28 shows the preceding vowel singing length-calculating process executed in the step S108.

Figure 29:
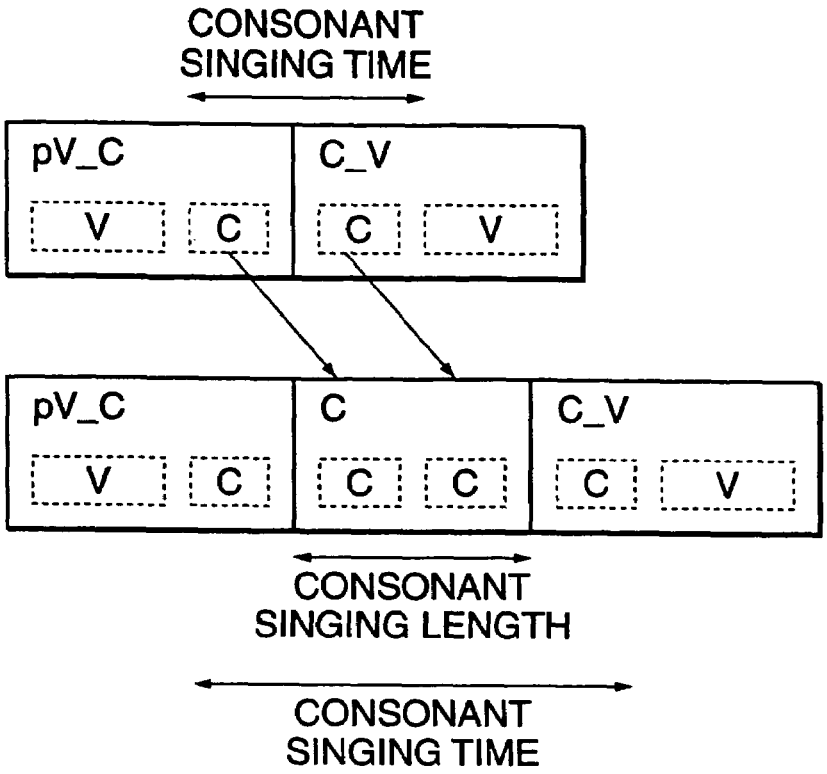
FIG. 29 is a diagram showing a consonant singing length-calculating process in the case of the consonant expansion/compression ratio being larger than 1, in the FIG. 28 process.

First, in a step S146, performance data, management data, and score data are obtained. In a step S148, it is determined whether or not PhU State=Consonant Vowel holds. If the answer to this question is affirmative (Y), in a step S150, the consonant singing length is calculated. In this case, as shown in FIG. 29, the consonant singing length is determined by adding together a consonant portion of the preceding vowel-to-consonant phonetic unit transition time length, a consonant singing length, a consonant portion of the consonant-to-vowel phonetic unit transition time length. Therefore, the consonant singing length is part of the consonant singing time.

FIG. 29 shows an example of determination of the consonant singing length carried out when the singing consonant expansion/compression ratio contained in the performance information is larger than 1. In this case, the sum of the consonant length of pV_C and the consonant length of C_V added together is used as a basic unit, and this basic unit is multiplied by the singing consonant expansion/compression ratio to obtain the consonant singing length C. Then, the consonant singing time is lengthened by interposing the consonant singing length C between pV_C and C_V.

Figure 30:
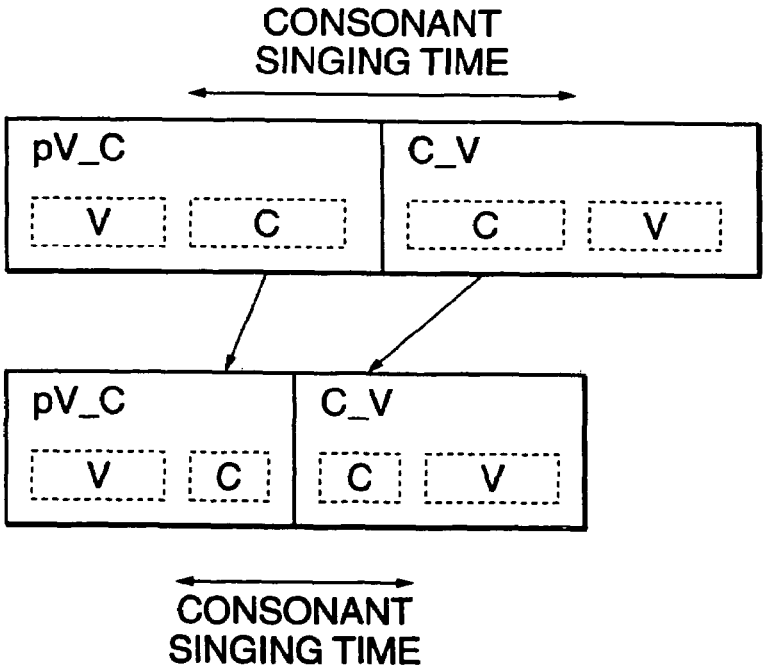
FIG. 30 is a diagram showing a consonant singing length-calculating process in the case of the consonant expansion/compression ratio being smaller than 1, in the FIG. 28 process.

FIG. 30 shows an example of determination of the consonant singing length carried out when the singing consonant expansion/compression ratio contained in the performance information is smaller than 1. In this case, the consonant length of pV_C and the consonant length of C_V are each multiplied by the singing consonant expansion/compression ratio to shorten the respective consonant lengths. As a result, the consonant singing time formed by the consonant length of pV_C and the consonant length of C_V is shortened.

Then, in a step S152, the preceding vowel singing length is calculated. As shown in FIG. 31, a preceding vowel singing time is determined by adding together a vowel portion of X (Sil_Consonant or vowel)-to-preceding vowel phonetic unit transition time length, a preceding vowel singing length, and a vowel portion of the preceding vowel-to-consonant or vowel phonetic unit transition time length. Therefore, the preceding vowel singing length is part of the preceding vowel singing time. Further, the reception of the present performance data makes definite the connection between the preceding performance data and the present performance data, so that the vowel singing length and V_Sil formed based on the preceding performance data are discarded. More specifically, the assumption that "silence is interposed between the present performance data and the next performance data" for use in the vowel singing length-calculating process in FIG. 32, described hereinafter, is annuled. In the step S152, in accordance with the order of singing, the preceding vowel singing length is calculated such that the boundary between the consonant portion of C_V and the vowel portion of the same, or the boundary between the preceding vowel portion of pV_V and the vowel portion of the same coincides with the actual singing-starting time point (Current Note On). In short, the preceding vowel singing length is calculated such that the singing-starting time point of the vowel of the present performance data coincides with the actual singing-starting time point.

Figure 31A:
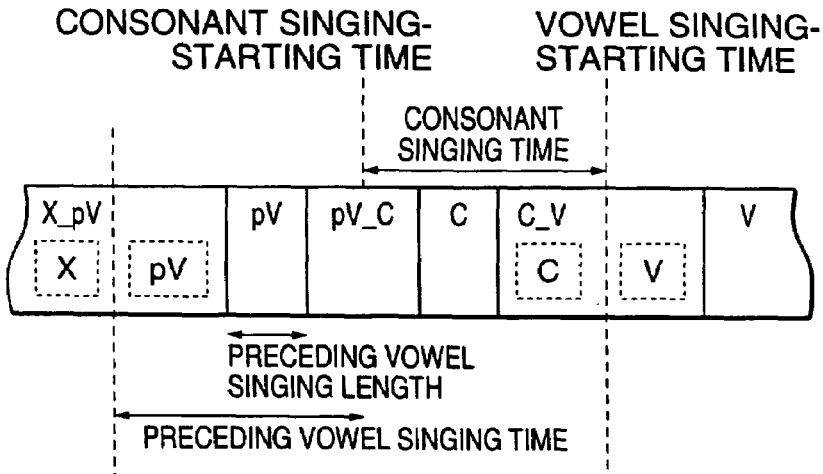
FIGS. 31A to 31C are diagrams showing examples of preceding vowel singing length calculation.
Figure 31B:
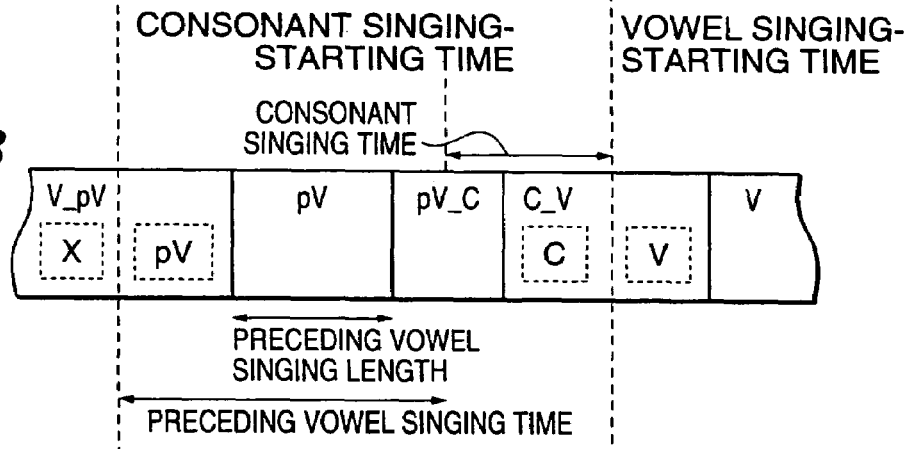
Figure 31C:
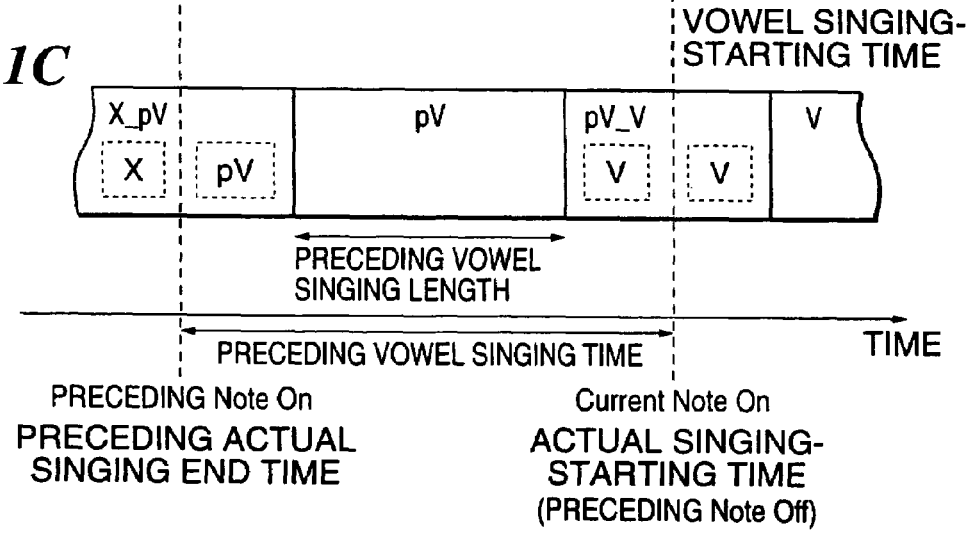

FIGS. 31A to 31C show phonetic unit connection patterns different from each other. The pattern shown in FIG. 31A corresponds to a case of a preceding vowel "a"-"sa", for example, in which to lengthen the consonant "s", the consonant singing length C is inserted. The pattern shown in FIG. 31B corresponds to a case of a preceding vowel "a"-"pa", for example. The pattern shown in FIG. 31C corresponds to a case of a preceding vowel "a"-"i", for example.

Figure 32:
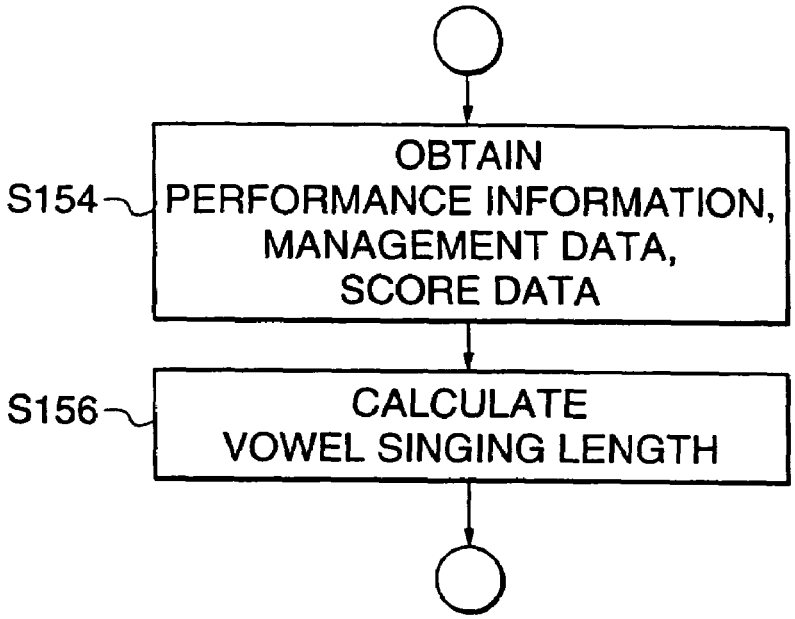
FIG. 32 is a flowchart showing a vowel singing length-calculating process.

FIG. 32 shows the vowel singing length-calculating process in the step S110.

Figure 33:
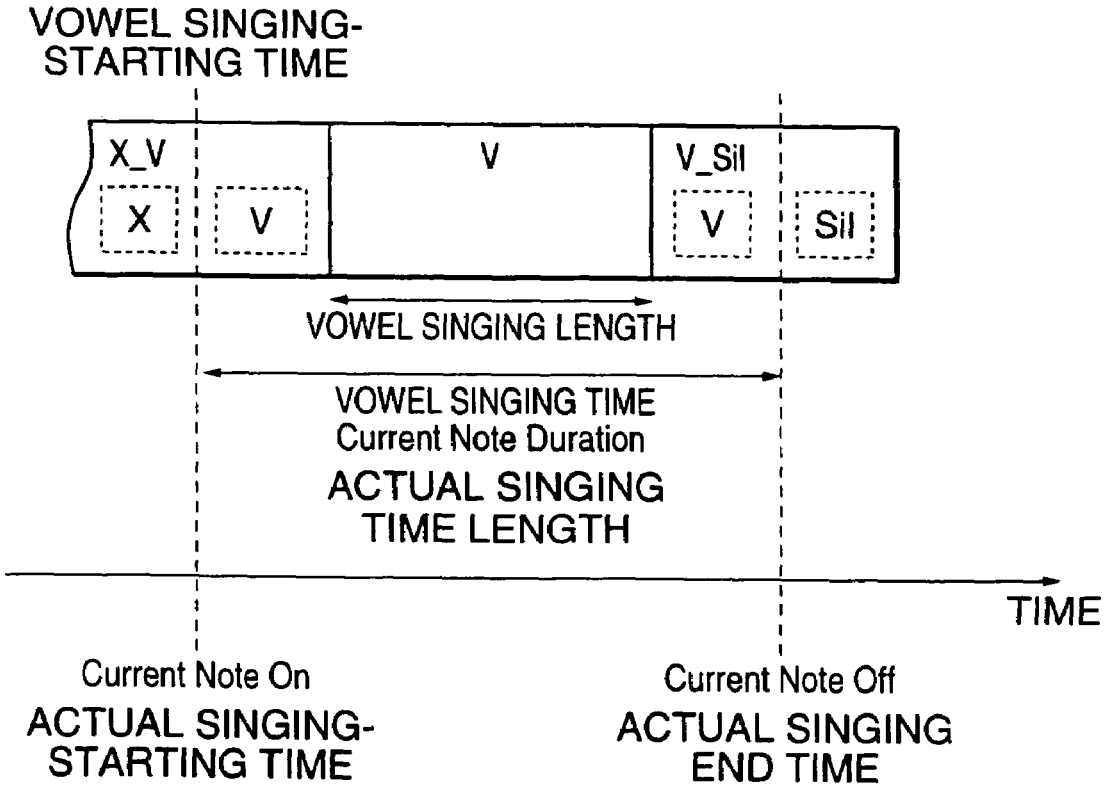
FIG. 33 is a diagram showing an example of vowel singing length calculation.

First, in a step S154, performance information, management data and score data are obtained. In a step S156, the vowel singing length is calculated. In this case, until the next performance data is received, a vowel connecting portion is not made definite. Therefore, it is assumed that "silence is interposed between the present performance data and the next performance data", and as shown in FIG. 33, the vowel singing length is calculated by connecting V_Sil to the vowel portion as shown in FIG. 33. At this time, the vowel singing time is temporarily determined by adding together a vowel portion of an X-to-vowel phonetic unit transition time length, a vowel singing length, and a vowel portion of a vowel-to-silence phonetic unit transition time length. Therefore, the vowel singing length becomes part of the vowel singing time. In the step S156, in accordance with the order of singing, the vowel singing length is calculated such that the boundary between the vowel portion and silence portion of V_Sil_Coincides with the actual singing end time point (Current Note Off).

When the next performance data is received, the state of connection (Event State) between the present performance data and the next performance data becomes definite, and if Event State=Attack holds for the next performance data, the vowel singing length of the present performance data is not updated, while if Event State=Transition holds for the next performance data, the vowel singing length of the present performance data is updated by the process in the step S152 described above.

Figure 34:
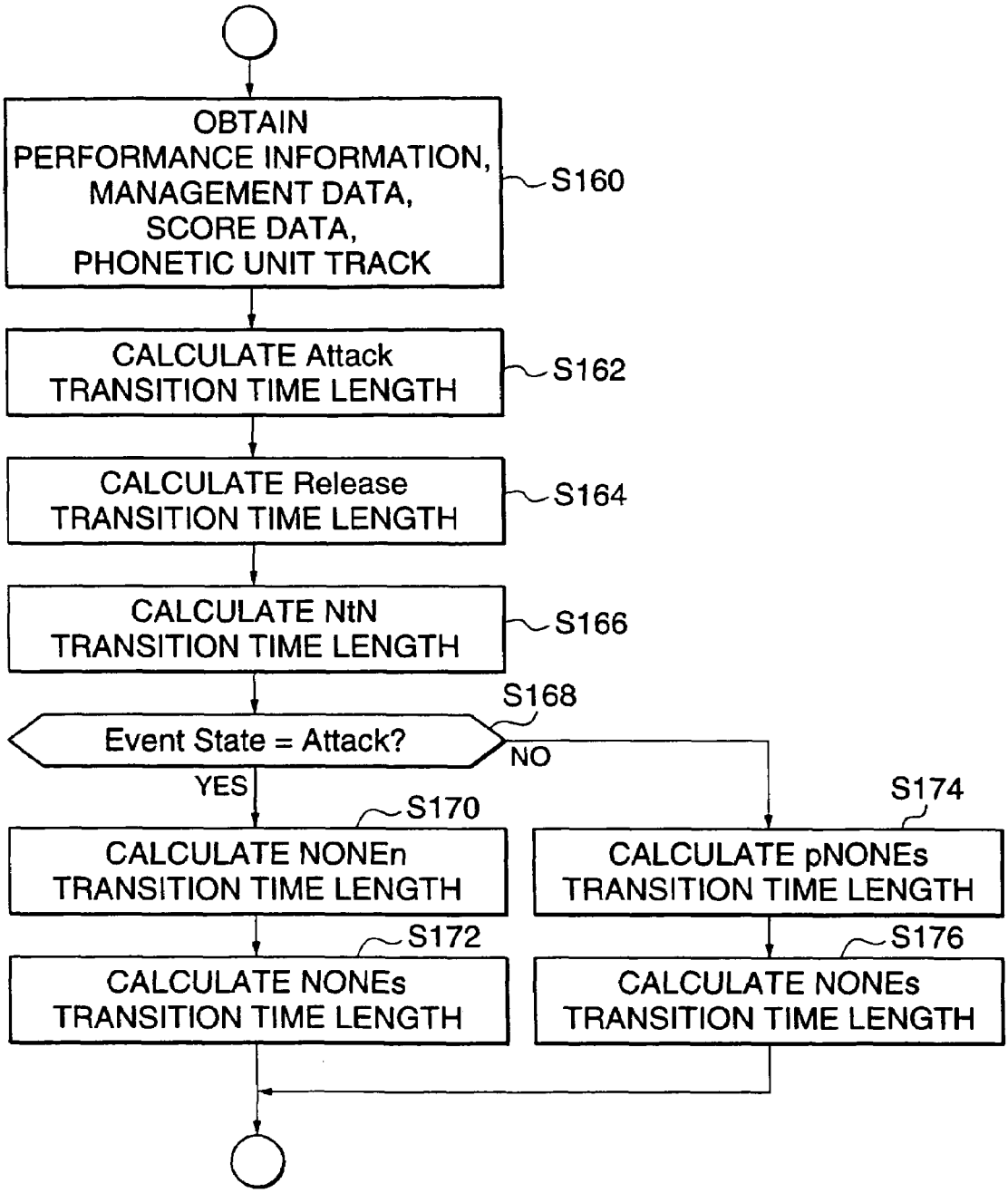
FIG. 34 is a flowchart showing a transition track-forming process.

FIG. 34 shows the transition track-forming process carried out in the step S82.

First in a step S160, performance information, management data, score data, and data of the phonetic unit track are obtained. In a step S162, an attack transition time length is calculated. To this end, the state transition time length of an attack transition state Attack corresponding to a singing attack type, a phonetic unit, and pitch, is retrieved from the state transition DB 14*c* shown in FIG. 7 based on the performance information and the management data. Then, the retrieved state transition time length is multiplied by a singing attack expansion/compression ratio in the performance information to obtain the attack transition time length (duration time of the attack portion).

In a step S164, a release transition time length is calculated. To this end, the state transition time length of a release transition state Release corresponding to a singing release type, a phonetic unit, and pitch, is retrieved from the state transition DB 14*c* based on the performance information and the management data. Then, the retrieved state transition time length is multiplied by a singing release expansion/compression ratio in the performance information to obtain the release transition time length (duration time of the release portion).

In a step S166, an NtN transition time length is obtained. More specifically, from score data stored in the step 86 in FIG. 18, the NtN transition time length from the preceding vowel (duration time of a note transition portion) is obtained.

Figure 35A:
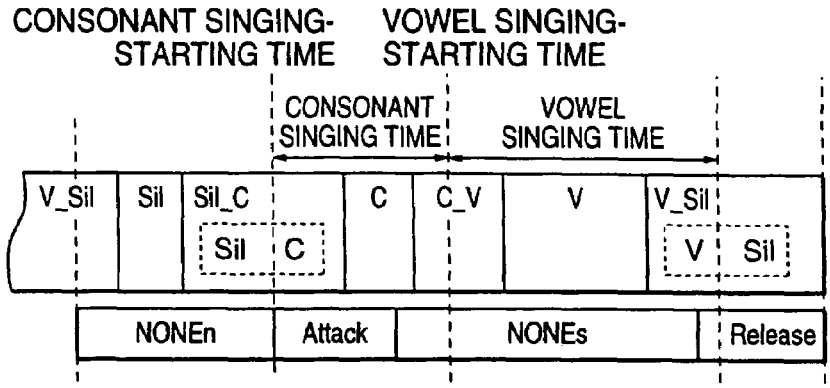
FIGS. 35A to 35C are diagrams showing examples of calculation of transition time lengths NONEn and NONEs.
Figure 35B:
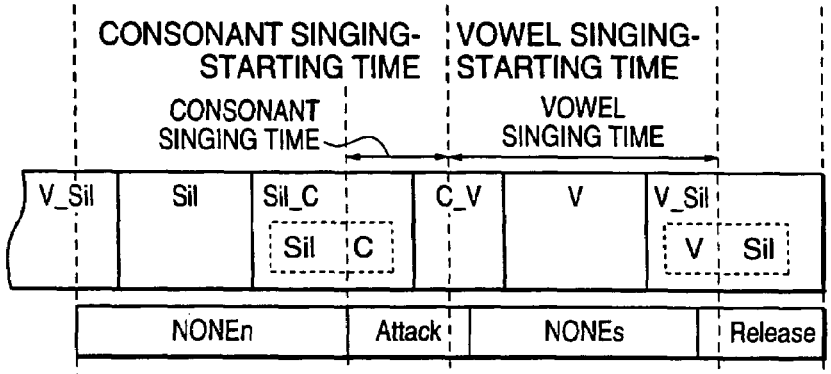
Figure 35C:
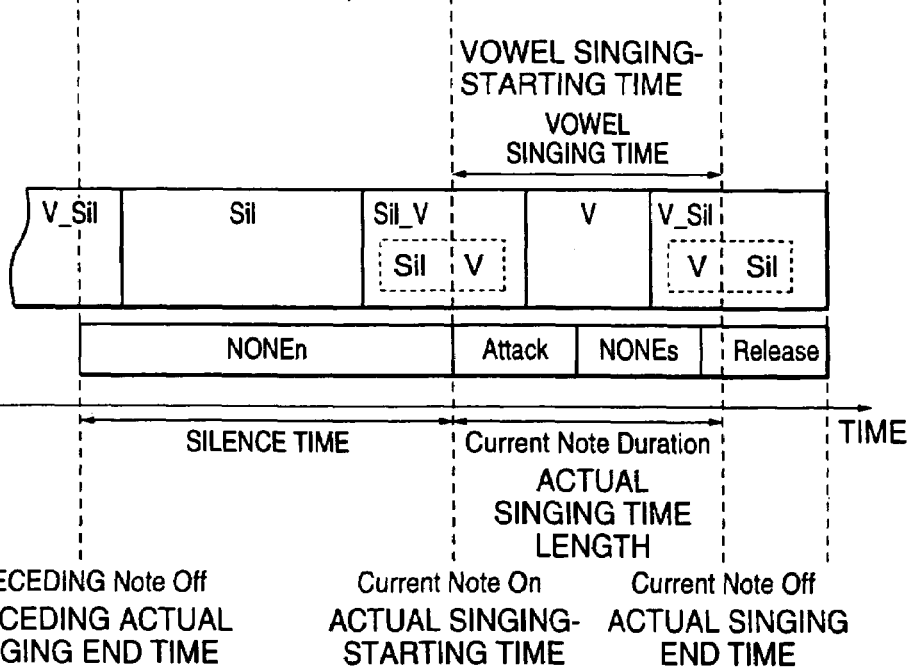

In a step S168, it is determined whether or not Event State=Attack holds. If the answer to this question is affirmative (Y), a NONE transition time length corresponding to the silence portion (referred to as "NONEn transition time length") is calculated in a step S1170. More specifically, in the case of PhU State=Consonant Vowel, as shown in FIGS. 35A and 35B, the NONEn transition time length is calculated such that the singing-starting time point of the consonant coincides with an attack transition-starting time point (leading end of the attack transition time length). The FIG. 35A example differs from the FIG. 35B example in that a consonant singing length C is interposed in the consonant singing time. In the case of PhU State=Vowel, as shown in FIG. 35C, the NONEn transition time length is calculated such that the singing-starting time point of the vowel coincides with the attack transition-starting time point.

In the step S170, the NONE transition time length corresponding to the steady portion(referred to as "NONEs transition time length) is calculated. In this case, until the next performance data is received, the state of connection following the NONEs transition time length is not made definite. Therefore, it is assumed that "silence is interposed between the present performance data and the next performance data", and as shown in FIGS. 35A to 35C, the NONEs transition time length is calculated with the release transition connected thereto. More specifically, the NONEs transition time length is calculated such that a release transition end time point (trailing end of the release transition time length) coincides with an end time point of V_Sil, based on an end time point of the preceding performance data, the end time point of V_Sil, the attack transition time length, the release time length and the NONEn transition time length.

Figure 36A:
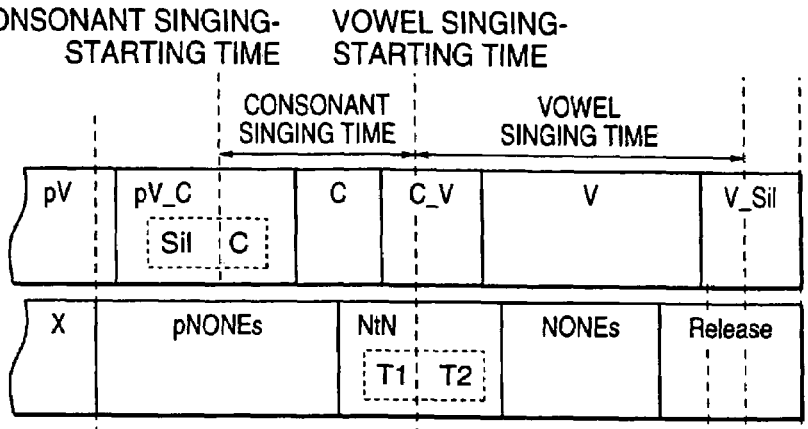
FIGS. 36A to 36C are diagrams showing an example of calculation of transition time lengths pNONEn and NONEs.
Figure 36B:
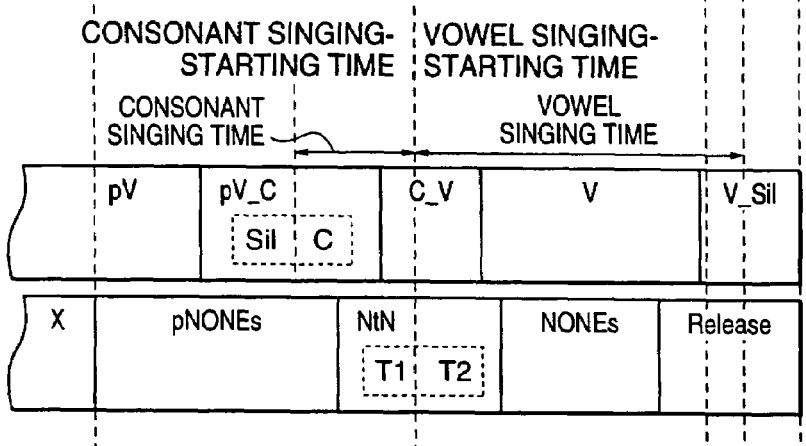
Figure 36C:
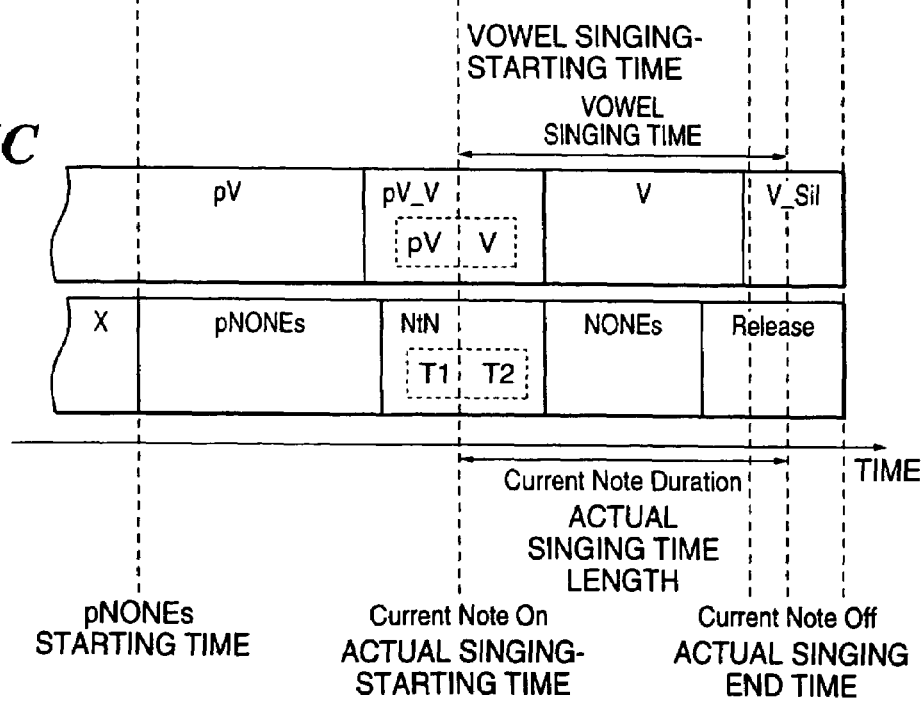

If the answer to the question of the step S168 is negative (N), in a step S174, a NONE transition time length corresponding to the steady portion of the preceding performance data (referred to as "pNONEs transition time length") is calculated. Since the reception of the present performance data has made definite the state of connection with the preceding performance data, the NONEs transition time length and the preceding release transition time length formed based on the preceding performance data are discarded. More specifically, the assumption "silence is interposed between the present performance data and the next performance data" employed in the processing in a step S176, described hereinafter, is annuled. In the step S174, as shown in FIGS. 36A to 36C, in both of the cases of PhU State=Consonant Vowel and PhU State=Vowel, the pNONEs transition time length is calculated such that the boundary between $T_{1\ and\ T2}$ of the NtN transition time length from the preceding vowel coincides with the actual singing-starting time point (Current Note On) of the present performance data based on the actual singing-starting time point and the actual singing end time point of the preset performance data and the NtN transition time length. The FIG. 36A example differs from the FIG. 36B example in that the consonant singing length C is interposed in the consonant singing time.

In the step S176, the NONE transition time length corresponding to the steady portion (NONEs transition time length) is calculated. In this case, until the next performance data is received, the state of connection with the NONEs transition time length is not made definite. Therefore, it is assumed that "silence is interposed between the present performance data and the next performance data", and as shown in FIGS. 36A to 36C, the NONEs transition time length is calculated with the release transition connected thereto. More specifically, the NONEs transition time length is calculated such that the boundary between $T_{1\ and\ T2}$ of the NtN transition time length continued from the preceding vowel coincides with the actual singing-starting time point (Current Note On) of the present performance data and at the same time, the release transition end time point (trailing end of the release transition time length) coincides with the end time point of V_Sil, based on the actual singing-starting time point of the present performance data, the end time point of V_Sil, the NtN transition time length continued from the preceding vowel, and the release transition time length.

Figure 37:
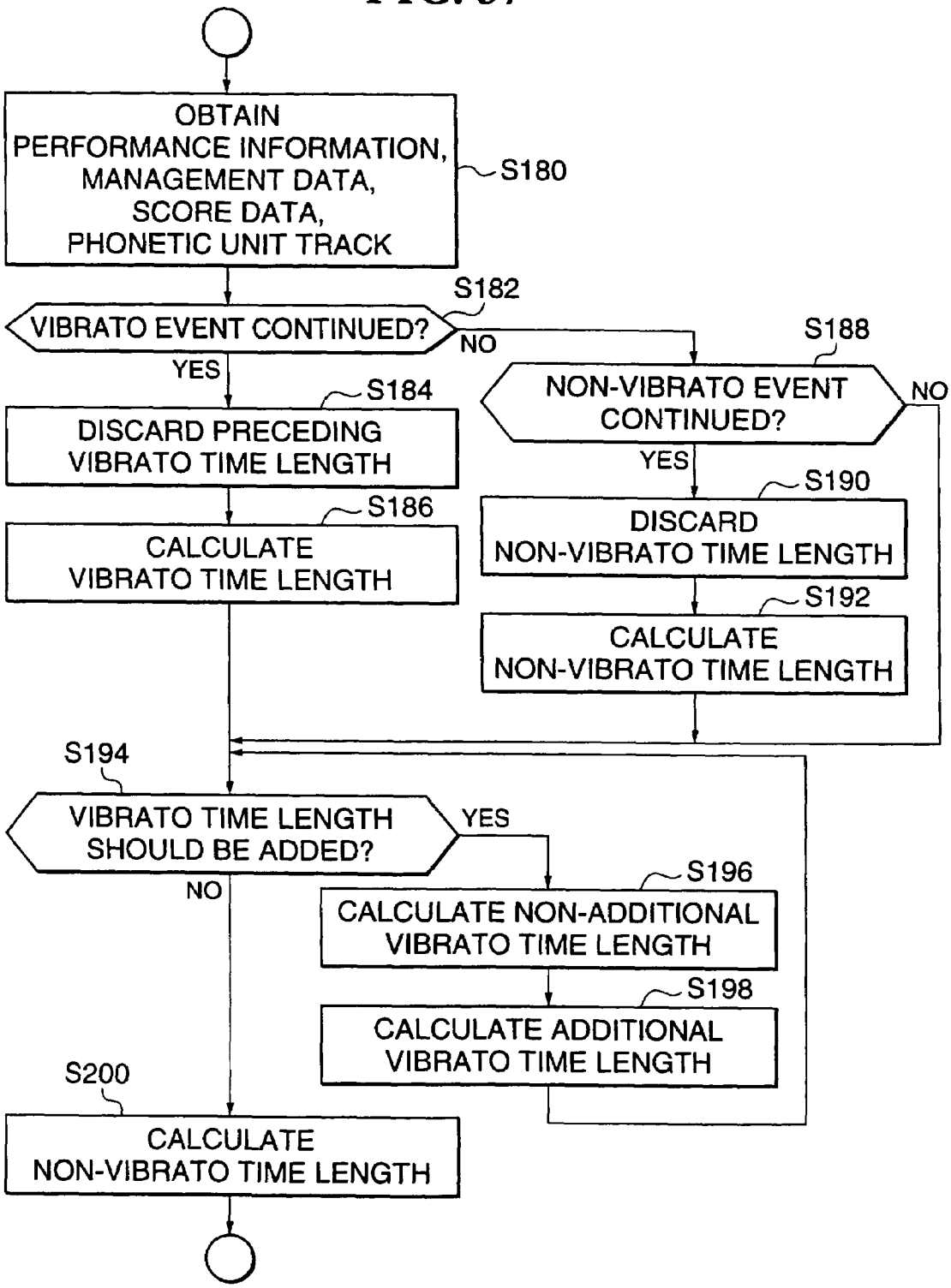
FIG. 37 is a flowchart showing a vibrato track-forming process.

FIG. 37 shows the vibrato track-forming process carried out in the step S84.

First, in a step S180, performance information, management data, score data, and data of a phonetic unit track are obtained. In a step S182, it is determined based on the obtained data whether or not the vibrato event should be continued. If vibrato is started at the actual singing-starting time point of the present performance data, and at the same time the vibrato-added state is continued from the preceding performance data, the answer to this question is affirmative (Y), so that the process proceeds to a step S184. On the other hand, although vibrato is started at the actual singing-starting time point of the present performance data, the vibrato-added state is not continued from the preceding performance data, or if vibrato is not started at the actual singing-starting time point of the present performance data, the answer to this question is negative (N), so that the process proceeds to a step S188.

Figures 38A, 38B, 38C, 38D, 38E:
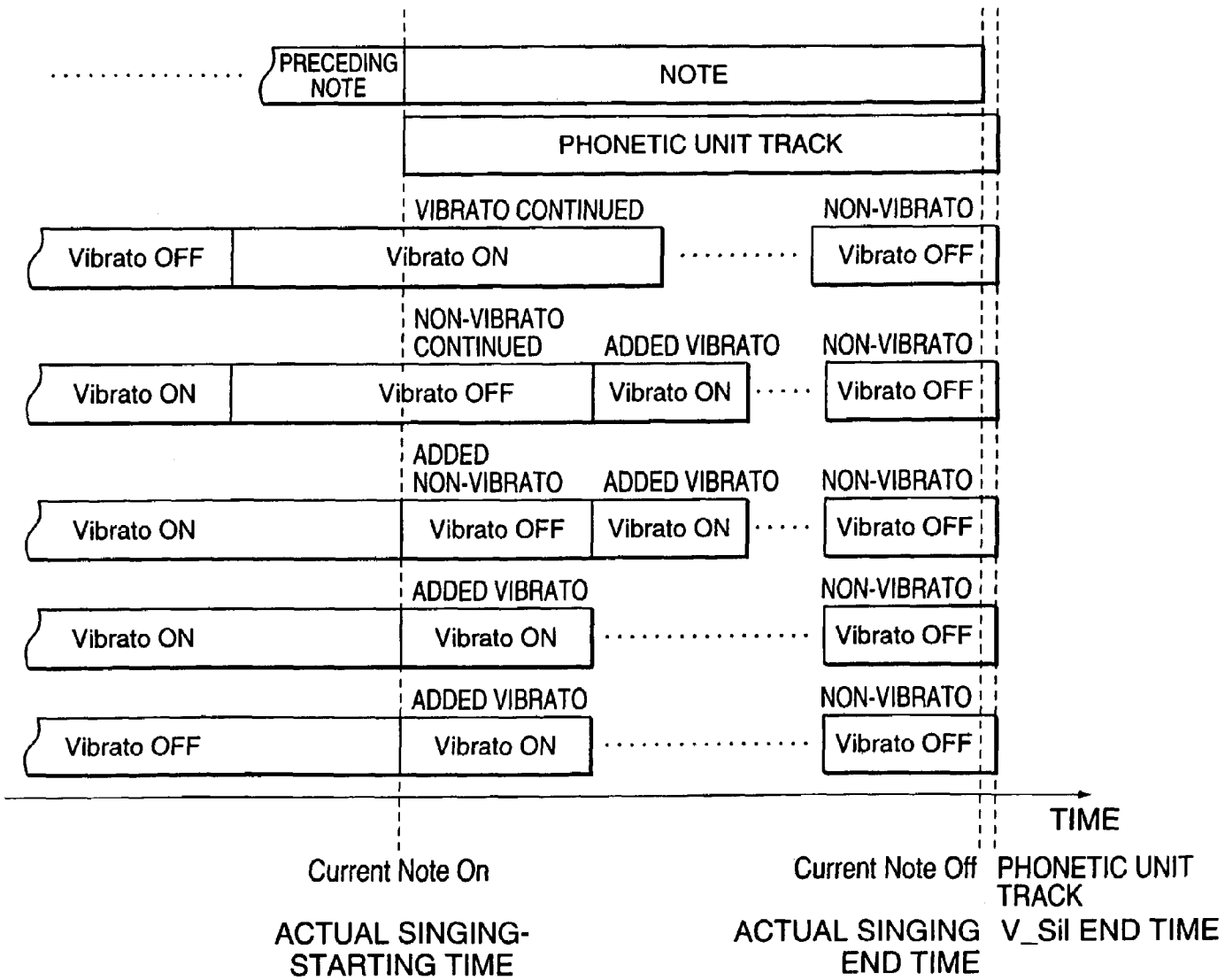
FIGS. 38A to 38E are diagrams showing examples of vibrato track formation.

In many cases, vibrato is sung over a plurality of performance data (notes). Even if vibrato is started at the actual singing-starting time point of the present performance data, there are a case as shown in FIG. 38A in which the vibrato-added state is continued from the preceding note, and a case as shown in FIGS. 38D, 38E in which the vibrato is additionally started at the actual singing-starting time point of the present note. Similarly, even as to the non-vibrato state (vibrato-non-added state), there are a case as shown in FIG. 38B in which the non-vibrato state is continued from the preceding note and a case as shown in FIG. 38C in which the non-vibrato state is started at the actual singing-starting time point of the present note.

In the step S188, it is determined based on the obtained data whether or not the non-vibrato event should be continued. In the FIG. 38B case in which the non-vibrato state is to be continued from the preceding note, the answer to this question becomes affirmative (Y), so that the process proceeds to a step S190. On the other hand, in the FIG. 38C case in which although the non-vibrato state is started at the actual singing-starting time point of the present note, this state is not continued from the preceding note, or in the case where the non-vibrato state is not started at the actual singing-starting time point of the present note, the answer to the question of the step S188 becomes negative (N), so that the process proceeds to a step S194.

If the vibrato event is to be continued, in the step S184, the preceding vibrato time length is discarded. Then, in a step S186, a new vibrato time length is calculated by connecting (adding) together the preceding vibrato time length and a vibrato time length of vibrato to be started at the actual singing-starting time point of the present note. Then, the process proceeds to the step S194.

If the non-vibrato event is to be continued, in the step S190, the preceding non-vibrato event time length is discarded. Then, a new non-vibrato event time length is calculated by connecting (adding) together the preceding non-vibrato time length and a non-vibrato time length of non-vibrato to be started at the actual singing-starting time point of the present note. Then, the process proceeds to the step S194.

In the step S194, it is determined whether or not the vibrato time length should be added. If the answer to this question is affirmative (Y), first, in a step S196, a non-additional vibrato time length is calculated. More specifically, a non-vibrato time length from the trailing end of the vibrato time length calculated in the step S186 to a vibrato time length to be added is calculated as the non-additional vibrato time length.

Then, in a step S198, an additional vibrato time length is calculated. Then, the process returns to the step S194, wherein the above-described process is repeated. This makes it possible to add a plurality of additional vibrato time lengths.

If the answer to the question of the step S194 is negative (N), the non-vibrato time length is calculated in a step S200. More specifically, a time period from the final time point of a final vibrato event to the end time point of V_Sil within the actual singing time length (time length between Current Note On to Current Note Off) is calculated as the non-vibrato time length.

Although in the above steps S142 to S152, the silence singing length or the preceding vowel singing length is calculated such that the singing-starting time point of the vowel of the present performance data coincides with the actual singing-starting time point, this is not limitative, but for the purpose of synthesizing more natural singing voices, the silence singing length, the preceding vowel singing length and the vowel singing length may be calculated as in (1) to (11) described below:

(1) For each of categories (unvoiced/voiced plosive sound, unvoiced/voiced fricative sound, nasal sound, half vowel, etc.) of consonants, a silence singing length, a preceding vowel singing length, and a vowel singing length are calculated. FIGS. 39A to 39E show examples of calculation of the silence singing length, showing that in the case where the consonant belongs to nasal sound or half vowel, the manner of determination of the silence singing length is made different from the other cases.

Figures 39A, 39B, 39C, 39D, 39E:
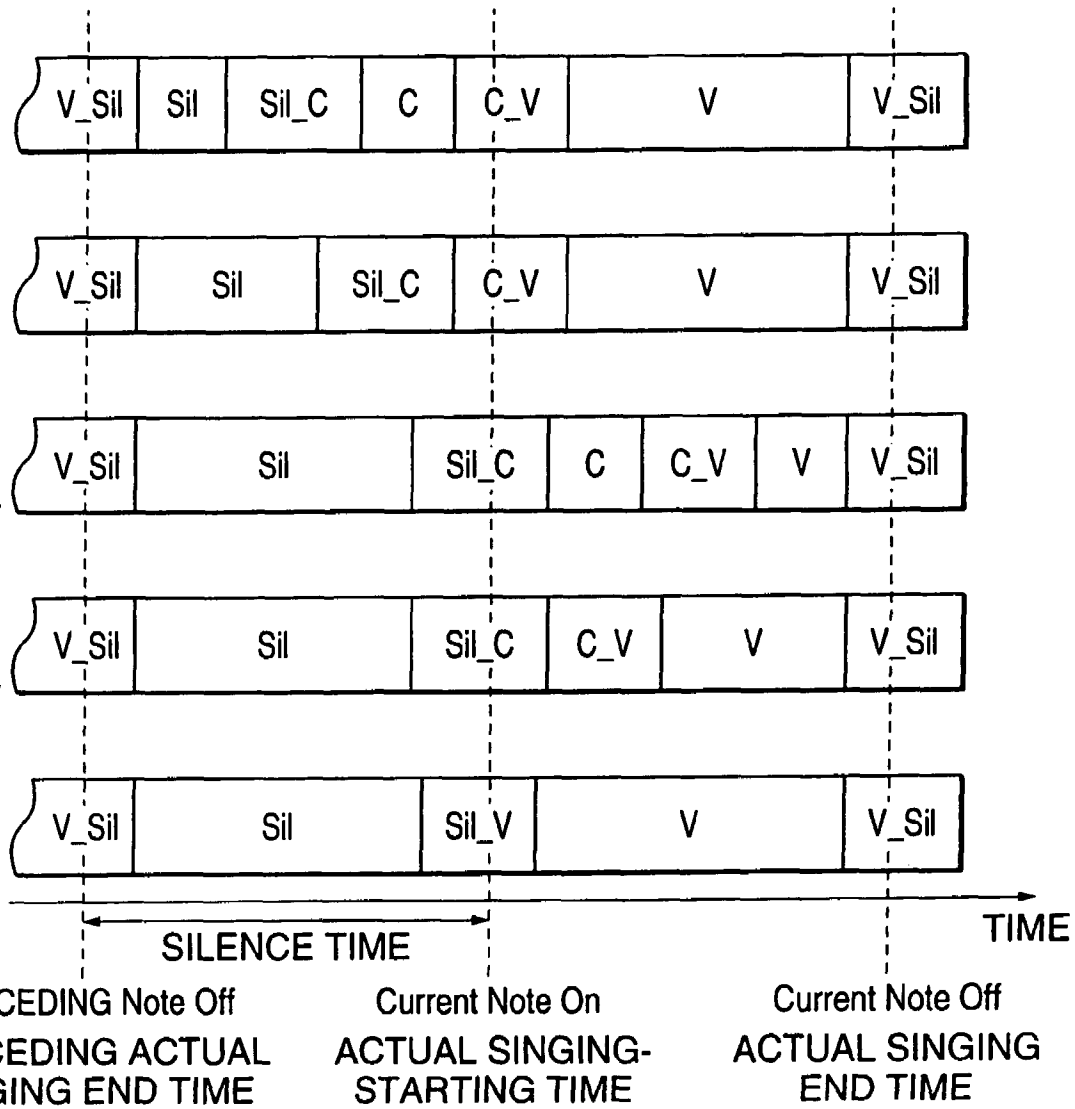
FIG. 39A to 39E show diagrams showing examples of variations of silence singing length calculation.

The phonetic unit connection pattern shown in FIG. 39A corresponds to a case of the preceding vowel "a"-silence-"sa". The silence singing length is calculated with the consonant singing length C being inserted to lengthen the consonant ("s" in this example) of a phonetic unit formed by a consonant and a vowel. The phonetic unit connection pattern shown in FIG. 39B corresponds to a case of the preceding vowel "a"-silence-"pa". The silence singing length is calculated without the consonant singing length being inserted for a phonetic unit formed by a consonant and a vowel. The phonetic unit connection pattern shown in FIG. 39C corresponds to a case of the preceding vowel "a"-silence-"na". The silence singing length is calculated with the consonant singing length C being inserted to lengthen the consonant ("n" in this example) of a phonetic unit formed by a consonant (nasal sound or half vowel) and a vowel. The phonetic unit connection pattern shown in FIG. 39D is the same as the FIG. 39C example except that the consonant singing length C is not inserted. The phonetic unit connection pattern shown in FIG. 39E corresponds to a case of the preceding vowel "a"-silence-"i". The silence singing length is calculated for a phonetic unit formed by vowels alone (the same applies to a phonetic unit formed by consonants (nasal sounds) alone).

In the examples shown in FIGS. 39A, 39B, and 39E, the silence singing length is calculated such that the singing-starting time point of the vowel of the present performance data coincides with the actual singing-starting time point. In the examples shown in FIGS. 39C and 39D, the silence singing length is calculated such that the singing-starting time point of the consonant of the present performance data coincides with the actual singing-starting time point.

(2) For each of consonants ("p", "b", "s", "z", "n", "w", etc.), a silence singing length, a preceding vowel singing length, a vowel singing length are calculated.

(3) For each of vowels ("a", "i", "u", "e", "o", etc.), a silence singing length, a preceding vowel singing length, a vowel singing length are calculated.

(4) For each of the categories (unvoiced/voiced plosive sound, unvoiced/voiced fricative sound, nasal sound, half vowel, etc.) of consonants, and at the same time for each vowel ("a", "i", "u", "e", "o", or the like) continued from the consonant, a silence singing length, a preceding vowel singing length and a vowel singing length are calculated. That is, for each combination of a category to which a consonant belongs and a vowel, the silence singing length, the preceding vowel singing length and the vowel singing length are calculated.

(5) For each of the consonants ("p", "b", "s", "z", "n", "w", etc.), and at the same time for each vowel continued from the consonant, a silence singing length, a preceding vowel singing length and a vowel singing length are calculated. That is, for each combination of a consonant and a vowel, the silence singing length, the preceding vowel singing length and the vowel singing length are calculated.

(6) For each of preceding vowels ("a", "i", "u", "e", "o", etc.), a silence singing length, a preceding vowel singing length, a vowel singing length are calculated.

(7) For each of the preceding vowels ("a", "i", "u", "e", "o", etc.), and at the same time for each category (unvoiced/voiced plosive sound, unvoiced/voiced fricative sound, nasal sound, half vowel, or the like) of a consonant continued from the preceding vowel, a silence singing length, a preceding vowel singing length and a vowel singing length are calculated. That is, for each combination of a preceding vowel and a category to which a consonant belongs, the silence singing length, the preceding vowel singing length and the vowel singing length are calculated.

(8) For each of the preceding vowels ("a", "i", "u", "e", "o", etc.), and at the same time for each consonant ("p", "b", "s", "z", "n", "w", or the like) continued from the preceding vowel, a silence singing length, a preceding vowel singing length and a vowel singing length are calculated. That is, for each combination of a preceding vowel and a consonant, the silence singing length, the preceding vowel singing length and the vowel singing length are calculated.

(9) For each of the preceding vowels "a", "i", "u", "e", "o", etc.), and at the same time for each vowel ("a", "i", "u", "e", "o", or the like) continued from the preceding vowel, a silence singing length, a preceding vowel singing length and a vowel singing length are calculated. That is, for each combination of a preceding vowel and a vowel, the silence singing length, the preceding vowel singing length and the vowel singing length are calculated.

(10) For each of the preceding vowels ("a", "i", "u", "e", "o", etc.), for each category (unvoiced/voiced plosive sound, unvoiced/voiced fricative sound, nasal sound, half vowel, or the like) of a consonant continued from the preceding vowel, and for each vowel ("a", "i", "u", "e", "o", or the like) continued from the consonant, a silence singing length, a preceding vowel singing length and a vowel singing length are calculated. That is, for each combination of a preceding vowel, a category to which a consonant belongs, and a vowel, the silence singing length, the preceding vowel singing length and the vowel singing length are calculated.

(11) For each of the preceding vowels ("a", "i", "u", "e", "o", etc.), for each consonant ("p", "b", "s", "n", "w", or the like) continued from the preceding vowel, and for each vowel ("a", "i", "u", "e", "o", or the like) continued from the consonant, a silence singing length, a preceding vowel singing length and a vowel singing length are calculated. That is, for each combination of a preceding vowel, a consonant, and a vowel, the silence singing length, the preceding vowel singing length and the vowel singing length are calculated.

The present invention is by no means limited to the embodiment described hereinabove by way of example, but can be practiced in various modifications and variations. Examples of such modifications and variations include the following:

(1) Although in the above described embodiment, after completing the forming of a singing voice synthesis score, singing voices are synthesized according to the singing voice synthesis score, this is not limitative, but while forming a singing voice synthesis score, singing voices may be synthesized based on the formed portion of the score. To carry out this, it is only required that while preferentially performing the reception of performance data by an interrupt handling routine, the singing voice synthesis score may be formed based on the received portion of the performance data.

(2) Although in the above embodiment, the formant-forming method is employed for the tone generation method, this is not limitative but a waveform processing method or other suitable method may be employed.

(3) Although in the above embodiment, the singing voice synthesis score is formed by three tracks of a phonetic unit track, a transition track and a vibrato track, this is not limitative, but the same may be formed by a single track. To this end, information of the transition track and the vibrato track may be inserted into the phonetic unit track, as required.

It goes without saying that the above described embodiment, modifications or variations may be realized even in the form of a program as software to thereby accomplish the object of the present invention.

Further, it also goes without saying that the object of the present invention may be accomplished by supplying a storage medium in which is stored software program code executing the singing voice-synthesizing method or realizing the functions of the singing voice-synthesizing apparatus according to the above described embodiment, modifications or variations, and causing a computer (CPU or MPU) of the apparatus to read out and execute the program code stored in the storage medium.

In this case, the program code itself read out from the storage medium achieves the novel functions of the above embodiment, modifications or variations, and the storage medium storing the program constitutes the present invention.

The storage medium for supplying the program code to the system or apparatus may be in the form of a floppy disk, a hard disk, an optical memory disk, an magneto-optical disk, a CD-ROM, a CD-R (CD-Recordable), DVD-ROM, a semiconductor memory, a magnetic tape, a nonvolatile memory card, or a ROM, for example. Further, the program code may be supplied from a server computer via a MIDI apparatus or a communication network.

Further, needless to say, not only the functions of the above embodiment, modifications or variations can be realized by carrying out the program code read out by the computer but also an OS (operating system) or the like operating on the computer can carry out part or whole of actual processing in response to instructions of the program code, thereby making it possible to implement the functions of the above embodiment, modifications or variations.

Furthermore, it goes without saying that after the program code read out from the storage medium has been written in a memory incorporated in a function extension board inserted in the computer or in a function extension unit connected to the computer, a CPU or the like arranged in the function extension board or the function extension unit may carry out part or whole of actual processing in response to the instructions of the code of the next program, thereby making it possible to achieve the functions of the above embodiment, modifications or variations.

What is claimed is:

1. A singing voice-synthesizing method comprising:

inputting phonetic unit information representative of a phonetic unit, time information representative of a singing-starting time point, and singing length information representative of a singing length, for a singing phonetic unit including a sequence of a first phoneme and a second phoneme;

generating a phonetic unit transition time length formed by a generation time length of the first phoneme and a generation time length of the second phoneme, based on the inputted phonetic unit information;

generating a state transition time length corresponding to a rise portion, a note transition portion, or a fall portion of the singing phonetic unit, based on the inputted phonetic unit information and the generated phonetic unit transition time length; and generating a singing voice formed by the phonetic unit, based on the phonetic unit information, the time information, and the singing length information which have been inputted, the generating step including adding a change in at least one of pitch and amplitude to the singing voice during a time period corresponding to the generated state transition time length.

2. A singing voice-synthesizing apparatus comprising:

an input section that inputs phonetic unit information representative of a phonetic unit, time information representative of a singing-starting time point, and singing length information representative of a singing length, for a singing phonetic unit including a sequence of a first phoneme and second phoneme;

a storage section that stores state transition time length corresponding to a rise portion, a note transition portion, or a fall portion of the singing phonetic unit, the state transition time length being generated based on inputted phonetic unit information and phonetic unit transition time length formed by a generation time length of the first phoneme and a generation time length of the second phoneme, based on the inputted phonetic unit information;

a readout section that reads out the state transition time length from said storage section based on the phonetic unit information inputted by said input section; and a singing voice-synthesizing section that generates a singing voice formed by the phonetic unit, based on the phonetic unit information, the time information, and the singing length information which have been inputted by said input section, said singing voice-synthesizing section adding a change in at least one of pitch and amplitude to the singing voice during a time period corresponding to the state transition time length read out by said readout section.

3. A singing voice-synthesizing apparatus according to claim 2, wherein said input section inputs modifying information for modifying the state transition time length, and wherein the singing voice-synthesizing apparatus includes a modifying section that modifies the state transition time length read out by said readout section based on the modifying information inputted by said input section, and wherein said singing voice-synthesizing section adds a change in at least one of pitch and amplitude to the singing voice during a time period corresponding to the state transition time length modified by said modifying section.

4. A storage medium storing a program for executing a singing voice-synthesizing method, the program comprising:

an input module that inputs phonetic unit information representative of a phonetic unit, time information representative of a singing-starting time point, and singing length information representative of a singing length, for a singing phonetic unit including a sequence of a first phoneme and a second phoneme;

a phonetic unit transition time length generating module that generates a phonetic unit transition time length formed by a generation time length of the first phoneme and a generation time length of the second phoneme, based on the inputted phonetic unit information a state transition time length-generating module that generates a state transition time length corresponding to a rise portion, a note transition portion, or a fall portion of the singing phonetic unit, based on the inputted phonetic unit information and the generated phonetic unit transition time length; and a singing voice-generating module that generates a singing voice formed by the phonetic unit, based on the phonetic unit information, the time information, and the singing length information which have been inputted, the singing voice-generating module adding a change in at least one of pitch and amplitude to the singing voice during a time period corresponding to the generated state transition time length.

* * * * *